US010563893B2

(12) United States Patent
Govekar et al.

(10) Patent No.: US 10,563,893 B2
(45) Date of Patent: Feb. 18, 2020

(54) SYSTEM AND METHOD FOR CHECKING AND CALIBRATING SCALE FOR MEASURING FLUID IN REFRIGERANT RECOVERY SYSTEM

(71) Applicant: Snap-on Incorporated, Kenosha, WI (US)

(72) Inventors: Craig F. Govekar, Gurnee, IL (US); Paolo Pennacchia, Florence (IT)

(73) Assignee: Snap-on Incorporated, Kenosha, WI (US)

( * ) Notice: Subject to any disclaimer, the term of this patent is extended or adjusted under 35 U.S.C. 154(b) by 142 days.

(21) Appl. No.: 15/899,913

(22) Filed: Feb. 20, 2018

(65) Prior Publication Data

US 2018/0363963 A1 Dec. 20, 2018

(30) Foreign Application Priority Data

Jun. 20, 2017 (IT) ..... 102017000068652

(51) Int. Cl.
*F25B 43/02* (2006.01)
*F25B 45/00* (2006.01)
*F25B 49/02* (2006.01)

(52) U.S. Cl.
CPC ..... *F25B 45/00* (2013.01); *F25B 49/02* (2013.01); *F25B 2345/003* (2013.01);
(Continued)

(58) Field of Classification Search
CPC ..... F25B 43/02; F25B 2345/001; F25B 2345/002; F25B 2345/003;
(Continued)

(56) References Cited

U.S. PATENT DOCUMENTS 4,513,578 A 4/1985 Proctor et al.
4,688,388 A 8/1987 Lower et al.
(Continued)

FOREIGN PATENT DOCUMENTS

DE 202006001376 U1 7/2007
EP 3040652 A1 6/2016
WO 2014165248 A1 9/2014

OTHER PUBLICATIONS

Vishay Tedea-Huntleigh; Single Point Aluminum Load Cell, Model 1022; Document No. 12007; Feb. 10, 2006.
(Continued)

*Primary Examiner* — Frantz F Jules
*Assistant Examiner* — Erik Mendoza-Wilkenfel
(74) *Attorney, Agent, or Firm* — McDonnell Boehnen Hulbert & Berghoff LLP

(57) ABSTRACT

Apparatuses, methods, and systems for adjusting scale(s) of a refrigerant recovery system (RRS) are described. The RRS can determine pressure and weight measurements of content within a refrigerant storage tank. The RRS can determine weight measurements of content within oil storage containers. The RRS can compare the pressure and weight measurements to thresholds to determine whether the scale(s) require adjusting, whether the RRS should be locked to prevent further use of the RRS until after servicing of the RRS, or whether additional functions of an operating state of the RRS should be performed. The RRS can comprise a processor to automatically adjust the scales, determine the pressure and weight measurements, and compare pressure and weight measurements to the thresholds. Locking the RRS can prevent the RRS from recovering refrigerant from a cooling system, such as an air conditioning system in a vehicle.

28 Claims, 17 Drawing Sheets

(52) U.S. Cl.
CPC . *F25B 2345/007* (2013.01); *F25B 2345/0052* (2013.01); *F25B 2500/24* (2013.01); *F25B 2700/04* (2013.01); *F25B 2700/19* (2013.01)

(58) Field of Classification Search
CPC .... F25B 2345/007; F25B 45/00; F25B 49/02; F17C 2250/0408; F17C 2250/0615
See application file for complete search history.

(56) References Cited

U.S. PATENT DOCUMENTS

| | | | | | |
|---|---|---|---|---|---|
| 4,726,435 | A | | 2/1988 | Kitagawa et al. | |
| 5,046,322 | A | | 9/1991 | Bulla et al. | |
| 5,067,327 | A | | 11/1991 | Leblanc | |
| 5,172,562 | A | | 12/1992 | Manz et al. | |
| 5,193,351 | A | | 3/1993 | Laukhuf et al. | |
| 5,230,224 | A | | 7/1993 | Ricketts et al. | |
| 5,285,647 | A | * | 2/1994 | Manz | F25B 45/00 62/127 |
| 5,359,859 | A | * | 11/1994 | Bench | F25B 45/00 62/292 |
| 5,367,888 | A | * | 11/1994 | Muston | B60H 1/00585 62/149 |
| 5,431,189 | A | | 7/1995 | Jones | |
| 5,560,215 | A | * | 10/1996 | Talarico | B60H 1/00585 62/149 |
| 5,603,224 | A | | 2/1997 | Scaringe et al. | |
| 5,709,091 | A | | 1/1998 | Todack | |
| 6,138,462 | A | | 10/2000 | Murray et al. | |
| 7,254,954 | B2 | | 8/2007 | Govekar et al. | |
| 7,310,956 | B2 | | 12/2007 | Meldahl et al. | |
| 7,310,964 | B2 | | 12/2007 | Govekar | |
| 7,905,095 | B2 | | 3/2011 | Suharno et al. | |
| 8,261,564 | B2 | | 9/2012 | Brown et al. | |
| 8,429,921 | B2 | | 4/2013 | Suharno et al. | |
| 9,366,488 | B2 | | 6/2016 | Sanhaji | |
| 2009/0158756 | A1 | | 6/2009 | Brown et al. | |
| 2012/0291457 | A1 | * | 11/2012 | Brown | F25B 45/00 62/77 |
| 2013/0284277 | A1 | | 10/2013 | Rahhli | |
| 2014/0166374 | A1 | | 6/2014 | Deng et al. | |
| 2015/0107279 | A1 | | 4/2015 | Sanhaji | |

OTHER PUBLICATIONS

Bacharach, Inc.; Stinger Refrigerant Recovery Unit; User Manual 2090-0217 Rev. 6; Apr. 2012.

Bosch Automotive Service Solutions LLC; Recovery/Recycling/Recharging Unit Operating Manual, Model 17800B / 17801B; Sep. 9, 2013.

Bosch Automotive Service Solutions LLC; Operating Manual for Model 34988 Recovery, Recycling, Recharging Unit; 554228 Rev. E; Jul. 30, 2013.

Snap-On Incorporated; Air Conditioning Equipment and Tools 2010 Catalog; Feb. 24, 2010.

Snap-On Incorporated; A/C Equipment and Tools; Are you Ready for A/C Season?; Mar. 26, 2013.

Snap-On Incorporated; Service Center, A/C, ECO Plus, R134a; downloaded from the World Wide Web at https://store.snapon.com/ECO-Plus-A-C-Service-Center_R134a-Service-Center-A-C-ECO-trade-Plus-R134a-P6478708.aspx; Mar. 21, 2016.

Propane 101; Promoting Propane Safety Through Better Understanding; downloaded from the World Wide Web at http://www.propane101.com/consumerlpgcylinderparts.htm; Jun. 27, 2016.

Mastercool, Inc.; Mastercool ECK1800 user manual—downloaded from the world wide web at http://www.mastercool.com/wp-content/uploads/2015/03/copia_di_d000004039_0002_0001.pdf; Mar. 2015, pp. 1-39 (English).

International Searching Authority; Search Report and Written Opinion for PCT/US2018/036189 dated Aug. 20, 2018.

Snap-On Incorporated; ECO Xtreme User's Manual, Mar. 7, 1997.

Ministry of Economic Development, Italian Patent and Trademark Office; search report Italian Patent Application No. IT 10201700068652, dated Feb. 22, 2018.

Ministry of Economic Development, Italian Patent and Trademark Office; office action Italian Patent Application No. IT 10201700068652, dated Mar. 14, 2018.

* cited by examiner

SYSTEM AND METHOD FOR CHECKING AND CALIBRATING SCALE FOR MEASURING FLUID IN REFRIGERANT RECOVERY SYSTEM

RELATED APPLICATION

This application claims priority to Italian Patent Application No. 102017000068652 entitled "System and Method for Checking and Calibrating Scale for Measuring Fluid in Refrigerant Recovery System," filed on Jun. 20, 2017, the contents of which are incorporated herein by reference in their entirety.

BACKGROUND

A cooling system can comprise a closed system that uses a refrigerant to cool the air in proximity to the cooling system. For example, most late model vehicles comprise an air conditioning system to cool air within a portion of the vehicle, such as a passenger compartment of an automobile or a storage area of a refrigerated van. In some instances, a refrigerant must be removed from the cooling system during service. A refrigerant recovery system (RRS) can be used to remove the refrigerant from the cooling system. The RRS can comprise a refrigerant storage tank (RST) to store the refrigerant removed from the cooling system. The RRS can be used to recharge the cooling system with the refrigerant stored in the RST. The RST occasionally needs to be filled with a refrigerant from a refrigerant supply that is not part of a cooling system. Some RRS comprise a scale to measure the weight of refrigerant within the RST to prevent overfilling the RST. Adjusting the refrigerant scale of an RRS automatically would remove the burden of a user having to determine whether the scale needs to be adjusted and remove the burden of having to adjust the refrigerant scale, assuming the refrigerant scale is adjustable.

OVERVIEW

Several example embodiments that relate to methods and systems for adjusting a scale of a refrigerant recovery system are described.

Viewed from one aspect, an example embodiment takes the form of an method performed by a system, for recovering refrigerant, comprising a refrigerant storage tank and a first scale, the method comprising: (i) determining, by at least one processor, the system transitioning to a first operating state; (ii) in response to determining the system transitioning to the first operating state, determining, by the at least one processor, a first pressure measurement, wherein determining the first pressure measurement comprises determining a pressure within the refrigerant storage tank is less than a pressure threshold; (iii) in response to determining the system transitioning to the first operating state, determining, by the at least one processor, a first weight measurement, wherein determining the first weight measurement comprises determining a weight of content in the refrigerant storage tank measured by the first scale is within a range between a first weight threshold and a second weight threshold; and (iv) in response to making the first pressure measurement and the first weight measurement, adjusting, by the at least one processor, the first scale to read zero.

Viewed from another aspect, an example embodiment takes the form of a system for recovering refrigerant, the system comprising: a refrigerant storage tank, a first scale, and at least one processor, wherein the at least one processor is adapted for: (i) determining the system is transitioning to a first operating state; (ii) in response to determining the system is transitioning to the first operating state, determining a first pressure measurement, wherein determining the pressure first measurement comprises determining a pressure within the refrigerant storage tank is less than a pressure threshold; (iii) in response to determining the system is transitioning to the first operating state, determining a first weight measurement, wherein determining the first weight measurement comprises determining a weight of content in the refrigerant storage tank measured by the first scale is within a range between a first weight threshold and a second weight threshold; and (iv) in response to making the first pressure measurement and the first weight measurement, adjusting the first scale to read zero.

Viewed from yet another aspect, an example embodiment takes the form of non-transitory computer-readable memory having stored therein instructions executable by at least one processor to cause a processor to perform functions comprising: (i) determining a system, comprising a refrigerant storage tank and a first scale, transitioning to a first operating state; (ii) in response to determining the system transitioning to the first operating state, determining, by the at least one processor, a first pressure measurement, wherein determining the first pressure measurement comprises determining a pressure within the refrigerant storage tank is less than a pressure threshold; (iii) in response to determining the system transitioning to the first operating state, determining a first weight measurement, wherein determining the first weight measurement comprises determining a weight of content in the refrigerant storage tank measured by the first scale is within a range between a first weight threshold and a second weight threshold; and (iv) in response to making the first pressure measurement and the first weight measurement, adjusting the first scale to read zero.

These as well as other aspects and advantages will become apparent to those of ordinary skill in the art by reading the following detailed description, with reference to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the following drawings.

DETAILED DESCRIPTION

I. Introduction

This description describes several example embodiments, at least some of which pertain to adjusting a scale of a refrigerant recovery system (RRS). At least some of the example embodiments disclosed herein include apparatuses, methods, and systems. Adjusting a scale within an RRS, such as a scale adapted for weighing refrigerant or a scale adapted for weighing refrigerant oil, may be desirable before the RRS is ever used to recover refrigerant from a cooling system. Adjusting a scale for weighing refrigerant may be desirable before filling the RST used by the RRS. Filling the RST during a fill RST operating state can comprise adding refrigerant from a supply tank of refrigerant that is not part of a cooling system. Filling the RST can comprise refilling the RST if the RST was filled previously. Filling the tank does not require adding an amount of refrigerant until no further refrigerant can be added into the RST.

In this description, the articles "a," "an," and "the" are used to introduce elements or functions of the example embodiments. The intent of using those articles is that there is one or more of the introduced elements or functions. In this description, the intent of using the conjunction "or" within a list of at least two elements or functions and the intent of using the terms "at least one of" and "one or more of" immediately preceding a list of at least two elements or functions is to cover each embodiment including a listed element or function independently and each embodiment comprising a combination of the listed elements or functions. For example, an embodiment described as comprising "A, B, or C," or "at least one of A, B, and C," or "one or more of A, B, and C" is intended to cover each of the following possible embodiments: (i) an embodiment comprising A, but not B and C, (ii) an embodiment comprising B, but not A and C, (iii) an embodiment comprising C, but not A and B, (iv) an embodiment comprising A and B, but not C, (v) an embodiment comprising A and C, but not B, (v) an embodiment comprising B and C, but not A, and (vi) an embodiment comprising A, B, and C. For the embodiments comprising element or function A, the embodiments can comprise one A or multiple A. For the embodiments comprising element or function B, the embodiments can comprise one B or multiple B. For the embodiments comprising element or function C, the embodiments can comprise one C or multiple C. In this description, the use of ordinal numbers such as "first," "second," "third" and so on is to distinguish respective elements rather than to denote a particular order of those elements unless the context of using those terms explicitly indicates otherwise.

Figure 7:
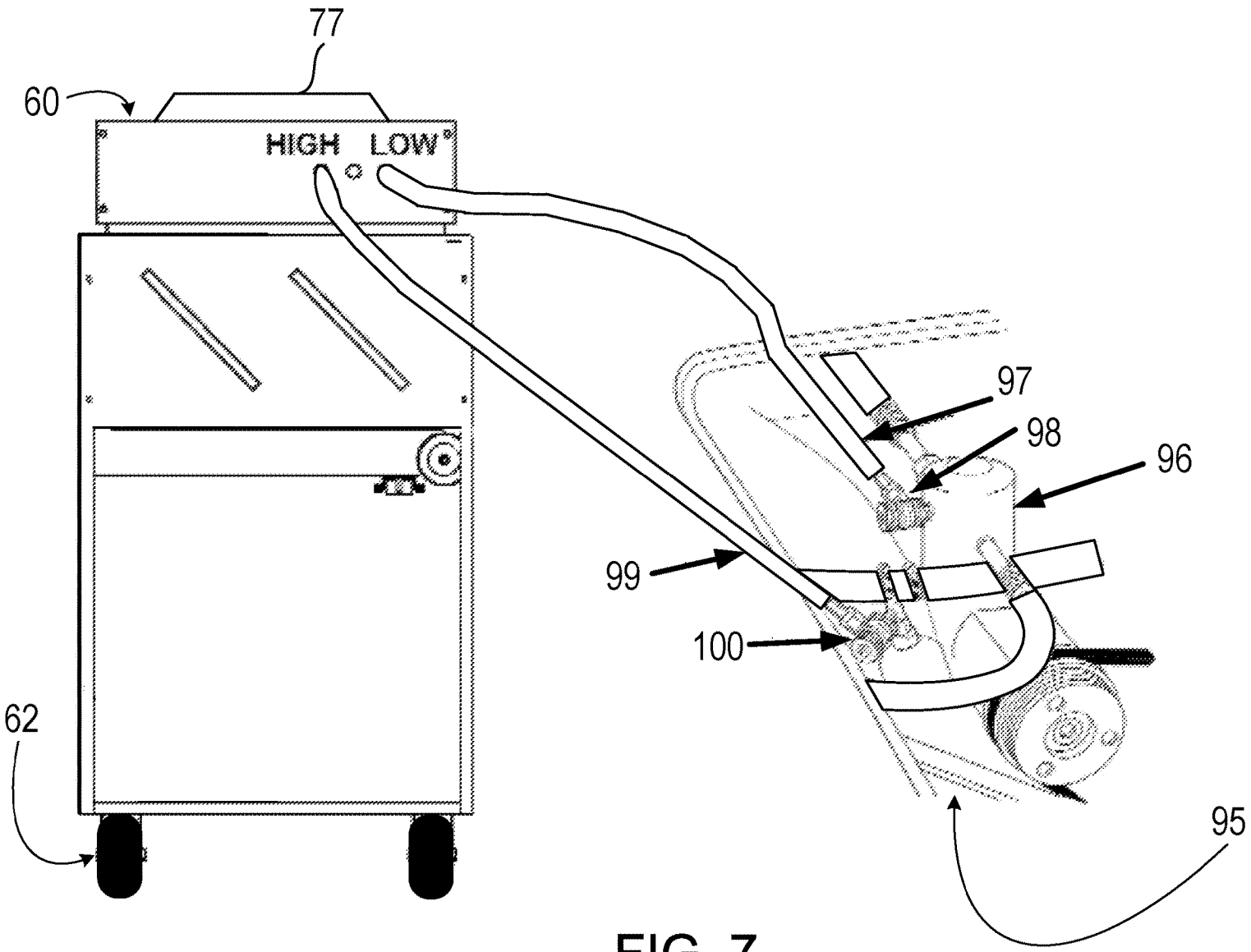
FIG. 7 is an illustration of the refrigerant recovery system shown in FIG. 5 connected to a vehicle, according to example embodiments.

A vehicle, such as vehicle 95 partially illustrated in FIG. 7, is a mobile machine that can be used to transport a person, people, or cargo. As an example, any vehicle discussed herein can be driven or otherwise guided along a path (e.g., a paved road or otherwise) on land, in water, or in the air or outer space. As another example, any vehicle discussed herein can be wheeled, tracked, railed, or skied. As yet another example, any vehicle discussed herein can include an automobile, a motorcycle, an all-terrain vehicle (ATV) defined by ANSI/SVIA-1-2007, a snowmobile, a personal watercraft (e.g., a JET SKI® personal watercraft), a light-duty truck, a medium-duty truck, a heavy-duty truck, a semi-tractor, or a farm machine. As an example, a vehicle guided along a path can include a van (such as a dry or refrigerated van), a tank trailer, a platform trailer, or an automobile carrier. As still yet another example, any vehicle discussed herein can include or use any appropriate voltage or current source, such as a battery, an alternator, a fuel cell, and the like, providing any appropriate current or voltage, such as about 12 volts, about 42 volts, and the like. As still yet another example, any vehicle discussed herein can include or use any desired system or engine to provide its mobility. Those systems or engines can include items that use fossil fuels, such as gasoline, natural gas, propane, and the like, electricity, such as that generated by a battery, magneto, fuel cell, solar cell and the like, wind and hybrids or combinations thereof. As still yet another example, any vehicle discussed herein can include an ECU, a data link connector (DLC), and a vehicle communication link that connects the DLC to the ECU.

The diagrams, flow charts, and data shown in the figures are provided merely as examples and are not intended to be limiting. Many of the elements illustrated in the figures or described herein are functional elements that can be implemented as discrete or distributed elements, individually or in conjunction with other element(s), and in any suitable combination or location. Those skilled in the art will appreciate that other arrangements and elements (e.g., machines, interfaces, functions, orders, or groupings of functions) can be used instead. Furthermore, the functions described as being performed by one or more elements can be carried out by a combination of hardware, firmware, or software (e.g., a processor that executes computer-readable program instructions).

II. Example Systems

Figure 1:
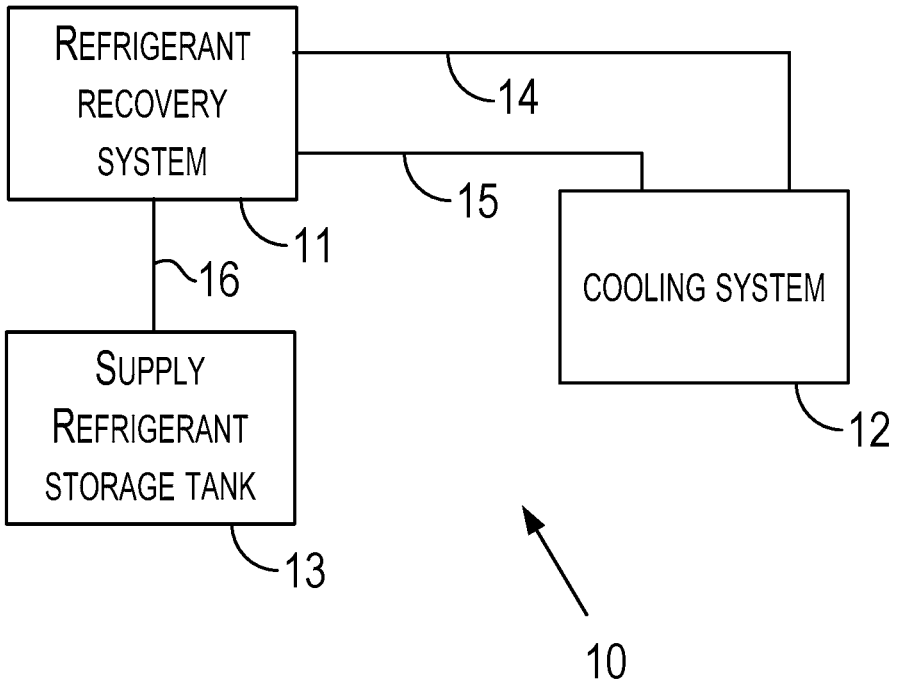
FIG. 1 is a block diagram of a system, according to example embodiments.

FIG. 1 is a simple block diagram of an example system 10 in which the example embodiments can operate. The system 10 comprises a refrigerant recovery system (RRS) 11, a cooling system (e.g., an air conditioning system or a refrigeration system) 12, and a supply refrigerant storage tank 13. The RRS 11 is removably connectable to the cooling system 12 using a hose, such as a low side hose 14 and a high side hose 15. The RRS 11 is removably connectable to the supply refrigerant storage tank 13 using a hose 16. The cooling system 12 can be part of a vehicle, such as the vehicle 95. Accordingly, any discussion in this description of an RRS being configured to recover refrigerant from a cooling system is intended to cover the RRS being configured to recover refrigerant from a vehicle as well as removing refrigerant from cooling systems outside of a vehicle, such as a THERMO KING® refrigeration unit mounted to the outside of a semi-tractor trailer, a refrigeration unit in a grocery store, or a walk-in cooler such as a KOLPAK® walk-in cooler or a KOLPAK® walk-in freezer. Moreover, an RRS being configured to recover refrigerant from a vehicle comprises the RRS being configured to recover refrigerant from an air conditioning system in the vehicle, for example.

The RRS 11 is configured to recover refrigerant from a cooling system, such as the cooling system 12. The refrigerant can be a fluid used in the cooling system 12. As an example, the refrigerant could comprise: (i) 1,1,1,2-tetrafluoroethane (commonly referred to as R-134a or HFC-134a), (ii) $CO_2$ (commonly referred to as R-744), (iii) hydrofluoroolefin (commonly referred to as HFO-1234yf), (iv) dichlorodifluoromethane (commonly referred to as R-12), (v) chlorodifluoromethane (commonly referred to as R-22), or (vi) some other refrigerant usable in the cooling system 12. The RRS 11 can additionally be configured to recover other fluids from systems that utilize refrigerants (e.g., refrigerant oil from a cooling system).

Figure 2:
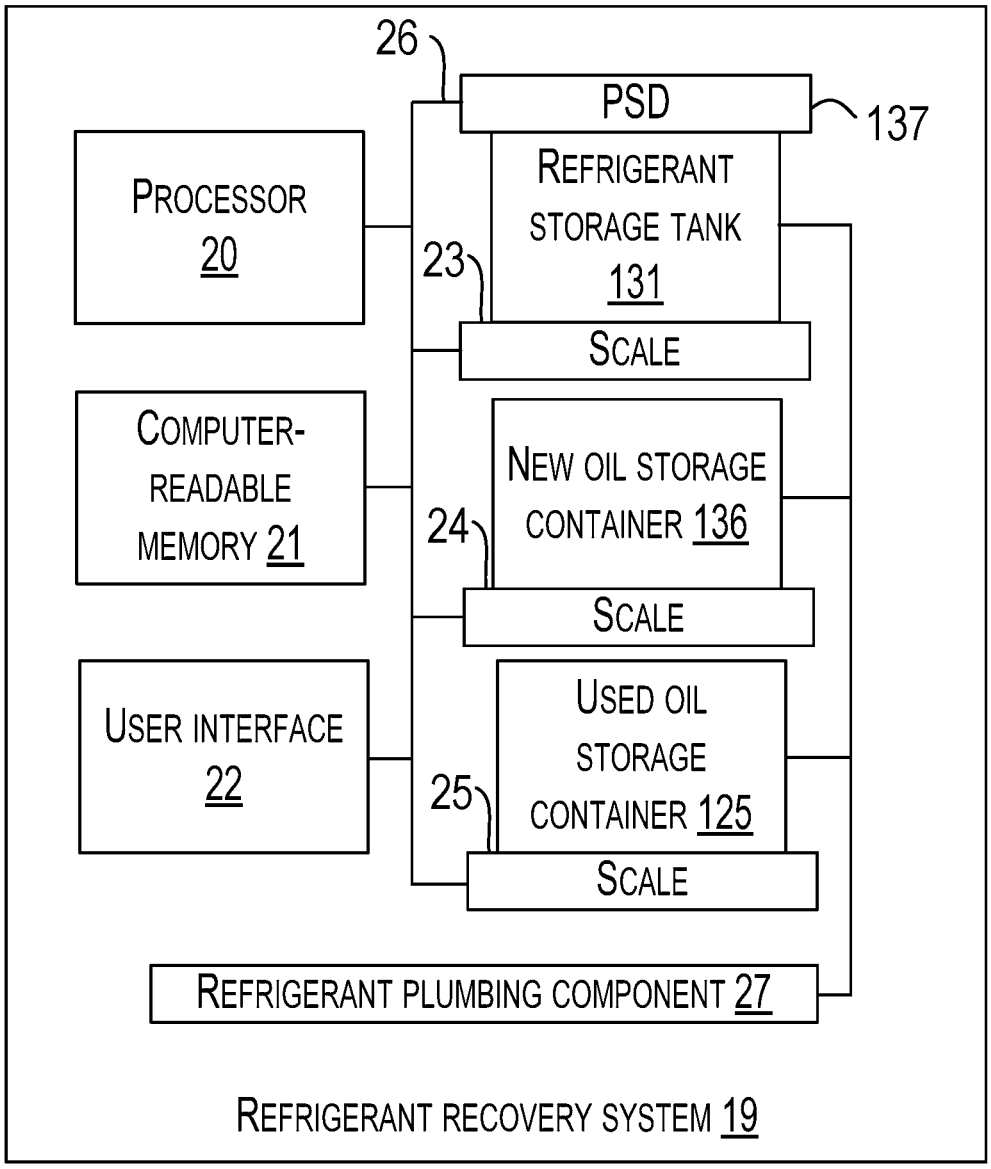
FIG. 2 is a block diagram of a refrigerant recovery system, according to example embodiments.

Next, FIG. 2 is a simple block diagram of a refrigerant recovery system (RRS) 19. The RRS 19 comprises a processor 20, a computer-readable memory (CRM) 21, a user interface (UI) 22, a refrigerant storage tank (RST 131), a new oil storage container 136, a used oil storage container 125, a pressure sensitive device (PSD) 137, a refrigerant plumbing component 27. Two or more of those components of the RRS 19 can be communicatively coupled or linked together via a system bus, network, or other connection mechanism 31. The RST 131 can comprise or be referred to as a "refrigerant cylinder." The RRS 19 also comprises scales 23, 24, and 25. The scales 23, 24, and 25 can be adapted for weighing content of the RST 131, the new oil storage container 136, and the used oil storage container 125, respectively.

The scales 23, 24, and 25 can be selected based on various factors, one of which is the tare weight of the RST 131, the new oil storage container 136, and the used oil storage container 125, respectively. As an example, the tare weight of the RST 131 can be 7.3 kg (i.e., about 16 pounds), the tare weight of both the new oil storage container 136, and the used oil storage container 125 individually can be 340 grams (i.e., about 12 ounces). As another example, the RST 131 having a water capacity of 13.6 kg (i.e., about 30 pounds) can have a tare weight of 9.3 kg (i.e., about 21 pounds). The processor 20 can adjust the scales 23, 24, and 25 or the signals output by the scales 23, 24, and 25 to exclude the tare weights of the RST 131, the new oil storage container 136, and the used oil storage container 125.

A processor, such as the processor 20 or any other processor discussed in this description, can comprise at least one processor. A processor can include a general purpose processor (e.g., an INTEL® single core microprocessor or an INTEL® multicore microprocessor), or a special purpose processor (e.g., a digital signal processor, a graphics processor, an embedded processor, or an application specific integrated circuit (ASIC) processor). A processor can be configured to execute computer-readable program instructions (CRPI). For example, the processor 20 can execute CRPI 41 (shown in FIG. 3). A processor can be configured to execute hard-coded functionality in addition to or as an alternative to software-coded functionality (e.g., via the CRPI). The processor 20 can be programmed to perform any function, any portion of a function, or combination of functions or portions of functions described herein as being performed by a processor.

A memory, such as the CRM 21 or any other memory discussed in this description, can include at least one computer-readable memory. A memory can comprise a non-transitory memory, a transitory memory, or both a non-transitory memory and a transitory memory. A non-transitory memory, or a portion thereof, can be located within or as part of a processor (e.g., within a single integrated circuit chip). A non-transitory memory, or a portion thereof, can be separate and distinct from a processor.

A non-transitory memory can include a volatile or non-volatile storage component, such as an optical, magnetic, organic or other memory or disc storage component. Additionally or alternatively, a non-transitory memory can include or be configured as a random-access memory (RAM), a read-only memory (ROM), a programmable read-only memory (PROM), an erasable programmable read-only memory (EPROM), an electrically erasable programmable read-only memory (EEPROM), or a compact disk read-only memory (CD-ROM). The RAM can include static RAM or dynamic RAM.

A transitory memory can include, for example, CRPI provided over a communication link. The communication link can include a digital or analog communication link. The communication link can include a wired communication link including one or more wires or conductors, or a wireless communication link including an air interface.

In addition to "computer-readable memory," a "memory" can be referred to by other terms such as a "computer-readable storage medium," a "data storage device," a "memory device," "computer-readable media," a "computer-readable database," "at least one computer-readable medium," or "one or more computer-readable medium." Any of those alternative terms can be preceded by the prefix "transitory" if the memory is transitory or "non-transitory" if the memory is non-transitory.

Figure 3:
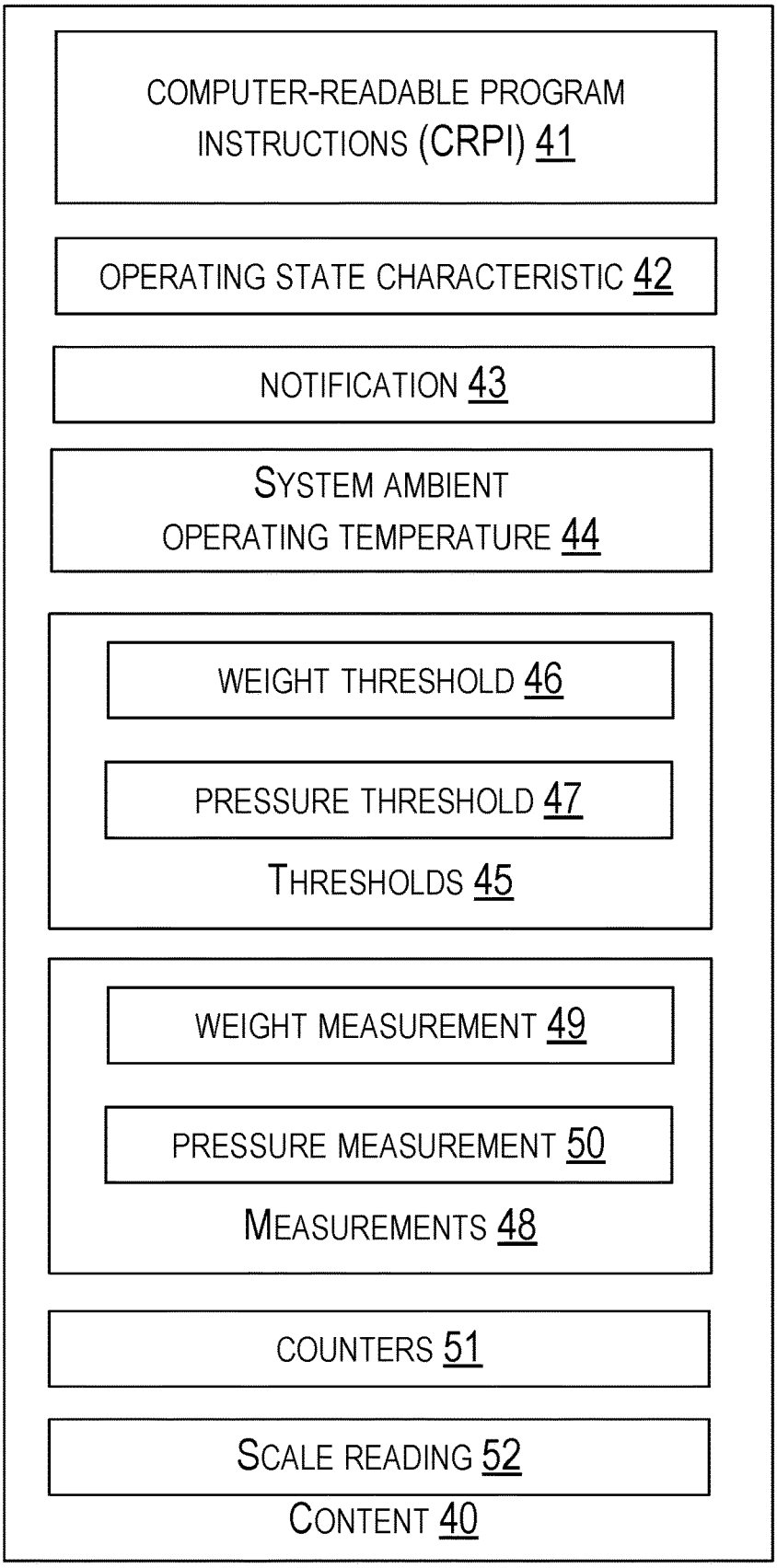
FIG. 3 is a diagram showing example content that can be stored in a computer-readable medium, according to example embodiments.

Next, FIG. 3 is a diagram showing example content 40 that can be stored in a CRM. The CRM 21 can comprise all or any portion of the content 40. A portion of the CRM 21 can be reserved for storing at least some of the content 40 if the content, such as measurement, has not yet been written to the CRM 21. As shown in FIG. 3, the content 40 comprises computer-readable program instructions 41, an operating state characteristic 42, a notification 43, a system ambient operating temperature 44, thresholds 45, measurements 48, counters 51, and a scale reading 52.

The CRPI 41 can comprise a plurality of program instructions. The CRPI 41 can include data structures, objects, programs, routines, or other program modules that can be accessed by a processor and executed by the processor to perform a particular function or group of functions and are examples of program codes for implementing steps for methods described in this description. The CRPI 41 can be written using one or more programming languages, such as ANSI-C, C++, or some other programming language. The CRPI 41 can comprise program instructions to perform any function shown in a flowchart in this application.

As an example, the CRPI 41 can comprise program instruction that cause the processor 20 to convert electrical signals received on its inputs (e.g., signals from the user interface 22, the refrigerant plumbing component, or a scale) into digital values the processor 20 uses to compare to a threshold in order to make a determination (e.g., a determination to lock the RRS 19 or to adjust a scale in the RRS). Any electrical signal described herein can comprise a radio signal.

The operating state characteristic (OSC) 42 can comprise a characteristic detectable by the processor 20. The processor 20 can store a representation of the detected characteristic as the OSC 42. As an example, the OSC 42 can comprise a signal level detected by the processor 20 on an input of the processor 20 or the OSC 42 can comprise a representation of the signal level detected by the processor 20. The input of the processor 20 an analog input, a digital input, or a power line input, for example. The processor 20 can use the OSC 42 to determine initiation of a new operating state has been requested, is occurring, or has occurred. As another example, the OSC 42 can comprise a signal received on a reset input of the processor 20.

As an example, the OSC 42 can be indicative of the RRS 11 transitioning to the refrigerant recovery operating state. In particular, the OSC 42 can be indicative of a particular phase of a multi-phase refrigerant operating state, such as a first phase when a compressor removes refrigerant from a cooling system without the assistance of a vacuum pump, a second phase when the compressor works in tandem with the vacuum pump to remove additional refrigerant from the cooling system after the first phase, or a third phase when the vacuum pump ceases assisting the compressor with removal of refrigerant from the cooling system. The OSC 42 to initiate the first phase can comprise an input indicative of a request to recover refrigerant. The OSC 42 to initiate the second phase can comprise a characteristic indicative that a pressure measured by a pressure sensitive device has reached a first pressure threshold. The OSC 42 to initiate the third phase can comprise a characteristic indicative that a pressure measured by the pressure sensitive device has reached a second pressure threshold.

As yet another example, the OSC 42 can be indicative of the RRS 11 transitioning to a recycle refrigerant operating state. During this state, refrigerant can be recycled through an oil evaporator/separator/vacuum chamber 116 (shown in FIG. 4) from the RST 131. The refrigerant can be in a liquid or gaseous form when flowing to the oil evaporator/separator/vacuum chamber 116. The refrigerant can flow through a manual valve 134 (shown in FIG. 4), as well as the electronic evaporator overpressure valve 135 (shown in FIG. 4), on its way to the oil evaporator/separator/vacuum chamber 116. The recycle refrigerant operating state can occur in conjunction with another operating state, such as the recover refrigerant operating state, or independent of the another operating state.

As yet another example, the OSC 42 can be indicative of the RRS 11 transitioning to a recharge refrigerant operating state. During this state, refrigerant from the RST 131 can be provided to the cooling system 12. The processor 20 can control a valve, such as a low pressure electronic valve 105, a high pressure electronic valve 106, or a refill electronic valve 143 (all shown in FIG. 4), to allow the refrigerant to flow from the RST 131 to the cooling system 12. The OSC 42 can comprise a signal received on an analog input of the processor 20 as a result of a recharge refrigerant switch 84 (shown in FIG. 5) being selected.

Figure 5:
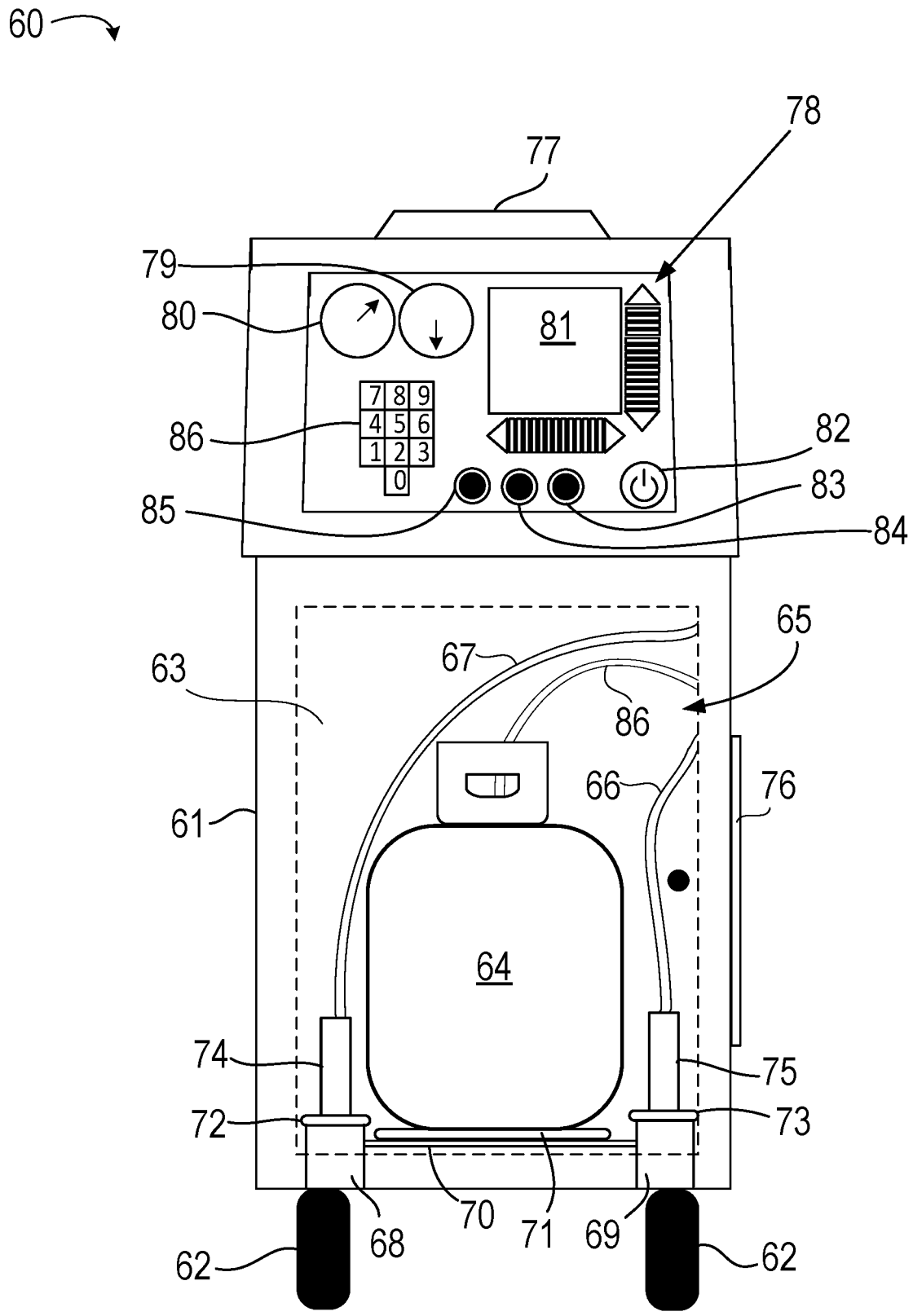
FIG. 5 is a front-view illustration of a refrigerant recovery system, according to example embodiments.

The notification 43 can comprise notifications the processor 20 outputs in response to determining a condition exists that warrants displaying the notification on a display, such as the display 81 shown in FIG. 5. The notification 43 can comprise a textual message or a non-textual message. The notification 43 can be arranged like an example notification shown in FIG. 8.

The system ambient operating temperature 44 can comprise a minimum system ambient operating temperature such as −10.0° centigrade (C), 0.0° C., or 4.5° C. The system ambient operating temperature 44 can comprise a maximum system ambient operating temperature such as 50.0° centigrade (C), 60.0° C., or 65° C. The processor 20 can read the system ambient operating temperature 44 to determine a vapor pressure associated with the RST 131, for example, by referring to a vapor pressure table.

The thresholds 45 comprise a weight threshold 46 and a pressure threshold 47. The thresholds 45 can comprise one or more additional thresholds, such as any other threshold described in this description. The weight threshold 46 can comprise multiple weight thresholds for comparison to weight measurements of the content within the RST 131, the content of the used oil storage container 125, or the content of the new oil storage container 136. Examples of a weight threshold are described below with respect FIG. 9, FIG. 16, and FIG. 18. The pressure threshold 47 can be compared to pressure measurements. Examples of the pressure threshold 47 are described below with respect to FIG. 9.

The measurements 48 comprise a weight measurement 49 and a pressure measurement 50. If the RRS 11 has not been used to make any measurements, the measurements 48 can comprise a portion of a CRM dedicated for storing the weight measurement 49 and the pressure measurement 50. The weight measurement 49 can comprise data representing a value of a signal received from a scale, such as the scale 23, 24, or 25. The pressure measurement 50 can represent a value of a signal received from a pressure sensitive device (e.g., the PSD 137). The weight measurement 49 can comprise any or all weight measurement(s) described in this description. The pressure measurement 50 can comprise any or all pressure measurement(s) described in this description.

The counters 51 can comprise one or more counters. A counter within the counters 51 can store data pertaining to the use of the RRS 19. As an example, the data stored in a counter can indicate how many times electrical power to the RRS 19 has been cycled off and back on, how many times an electric valve within the RRS 19 has been opened or closed, how many time the RRS 19 has transitioned to a particular operating state of the RRS 19, how many tank fills have been performed by the RRS 19. Other examples of the data stored or storable in the counters 51 are also possible.

In particular, the counters 51 can comprise a lifetime recovery counter to store data representing how much refrigerant from cooling system(s) has been recovered by the RRS during its lifetime. If the RRS 11 has not been used to recover any refrigerant, then the lifetime recovery counter can comprise data representing that no refrigerant has been recovered during the lifetime of the RRS 11. In that case, the CRM 21 can store a value equal to zero in a portion of the CRM 21 dedicated for storing the lifetime recovery counter, for example. The processor 20 can aggregate amounts of refrigerant recovered during each recover refrigerant operating state. An amount of refrigerant recovered during each recover refrigerant operating state can be equal to a difference in a weight of content in the RST 131 after completing the recover refrigerant operating state and a weight of the content in the RST 131 just prior to initiating the recover refrigerant operating state. The processor 20 can use the lifetime recovery counter alone or in combination with another counter or other data to determine whether or not a used oil storage container contains any oil. In that regard, another counter of the counters 51 can comprise data indicative of a dipstick or float level in the used oil storage container. The scale reading 52 comprises data representing a weight measured by a scale (e.g., the scale 23, 24, 25, 71, 72, or 73). The processor 20 can read an electrical signal output by the scale to determine a value to store as the scale reading 52. The electrical signal can comprise a differential voltage signal provided via a circuit connected to the scale. As an example, a value of 1.0 volts output by the scale 24 or via a circuit connected to the scale 24 can represent a weight of 42.5 grams.

Returning to FIG. 2, the UI 22 can include one or more UI input components configured so that a user of the RRS 19 can input data to or for use by the processor 20 or another item of the RRS 19. As an example, the UI input components can comprise a touch screen display, a user input section having one or more input keys, a pointing device such as a computing system mouse, a keyboard (e.g., a QWERTY keyboard), a display pointer (e.g., a computer mouse input device), or a microphone for receiving spoken inputs.

The UI 22 can include one or more UI output components configured for outputting (e.g., presenting) data via the RRS 19. As an example, the UI output components can include an analog display for visually presenting data, such as a notification, a data entry screen, a graphical user interface, measurement data, or analyzed measurement data. The display can comprise a display implemented using any of a variety of technologies, such as a light emitting diode (LED) display, a liquid crystal display (LCD), an organic LED (OLED) display, an active-matrix OLED display or some other type of display. As another example, the UI output components can include an audio speaker to audibly present data to a user of the RRS 19. Some components of the UI 22, such as a touch screen display, can function as both a UI input component and as a UI output component.

A scale, such as scale 23, 24, or 25 or any other scale described in this description, can comprise a spring scale or a load cell. The load cell can comprise a strain gauge load cell (e.g., a shear beam load cell, a double-ended shear beam load cell, an S-type load cell, or a compression load cell), a hydraulic load cell, or a pneumatic load cell, for example. The load cell can comprise a transducer, whereby a voltage or a current output signal indicates a value of a corresponding force acting on the load cell. As an example, the scale 23 can comprise a 35.0 kilogram (kg) scale, the scale 24 can comprise a 15.0 kg scale, and the scale 25 can comprise a 15.0 kg scale. Other examples of the scales 23, 24 or 25 are also possible.

The scale 23, 24, or 25 can be configured to measure force acting on the scale. This force can be output as an electrical signal, in some embodiments. The electrical signal can be provided to the processor 20. The force measured by the scale can correspond to the weight applied to the scale by the other components of the RRS 11. After accounting for the weight of all the other components of the RRS 11 (e.g., by calibrating or zeroing the reading of the scale when there is no fluid in the RST 131 or oil storage container to be weighed), the force measured by the scale can correspond to the amount (weight) of refrigerant in the RST 131 or oil storage container.

The scale 23, 24, or 25 can rest on, hang from, or be mounted to one or more other components of the RRS 11. For example, the scale 23, 24, or 25 can be bolted, screwed, nailed, adhered to, or welded to the one or more other components of the RRS 11.

The used oil storage container 125 comprises a container 125 for storing used oil that was within a vacuum pump 111 (shown in FIG. 4) or the oil evaporator/separator/vacuum chamber 116 (shown in FIG. 4), for example, in performing tasks required for recovering refrigerant from the cooling system 12. The used oil container 125 is detachable or interchangeable by a user of the RRS 11.

The RST 131 can store the refrigerant that is recovered from the cooling system 12 after the refrigerant passes through the other portions of the RRS 11. The RST 131 can be detachable or interchangeable by a user of the RRS 11. The RST 131 can also store the refrigerant that is supplied from the supply RST 13.

The new oil storage container 136 comprises a container for storing oil for injection into the cooling system 12 by the RRS 11. For purposes of this description, "oil" comprises polyalkylene glycol (PAG) oil or some other oil specified for use in the cooling system 12. The PAG oil can be injected by the RRS 11 into the cooling system 12 for use by a compressor within the cooling system 12, for example. Preferably, the oil stored in the new oil storage container 136 comprises new oil (e.g., unused cooling system oil or recycled/cleaned cooling system oil). Any type of oil storage container described in this description can comprise a glass or plastic bottle, for example. The processor 20 can control a refilling new oil electronic valve 147 to allow oil from the new oil storage container to be added into the cooling system 12 be recharged with refrigerant.

The pressure sensitive device 137 can include a level indicator that outputs an electrical signal to the processor 20. As an example, the PSD 137 can comprise a strain gauge pressure transducer, a capacitance pressure gauge, a piezoelectric type pressure sensor, an optical type pressure sensor, a fiber-optic type pressure sensor, or a manometer. Other examples of the PSD 137 are also possible. The processor 20, based on the output of the level indicator, can cause the user interface 22 to display a notification indicative of how much fluid is within the RST 131 or when the RST 131 needs to be replaced or filled. Causing a notification to be displayed on the user interface 22 can include the processor 20 outputting the notification to the user interface 22. The notification based on the electrical signal output by the PSD 137 can be include a numeric value in units such as bar, millibar, or pound per square inch (PSI), for example. 1 bar equals 100,000 pascals and approximately 14.5 PSI.

Figure 4:
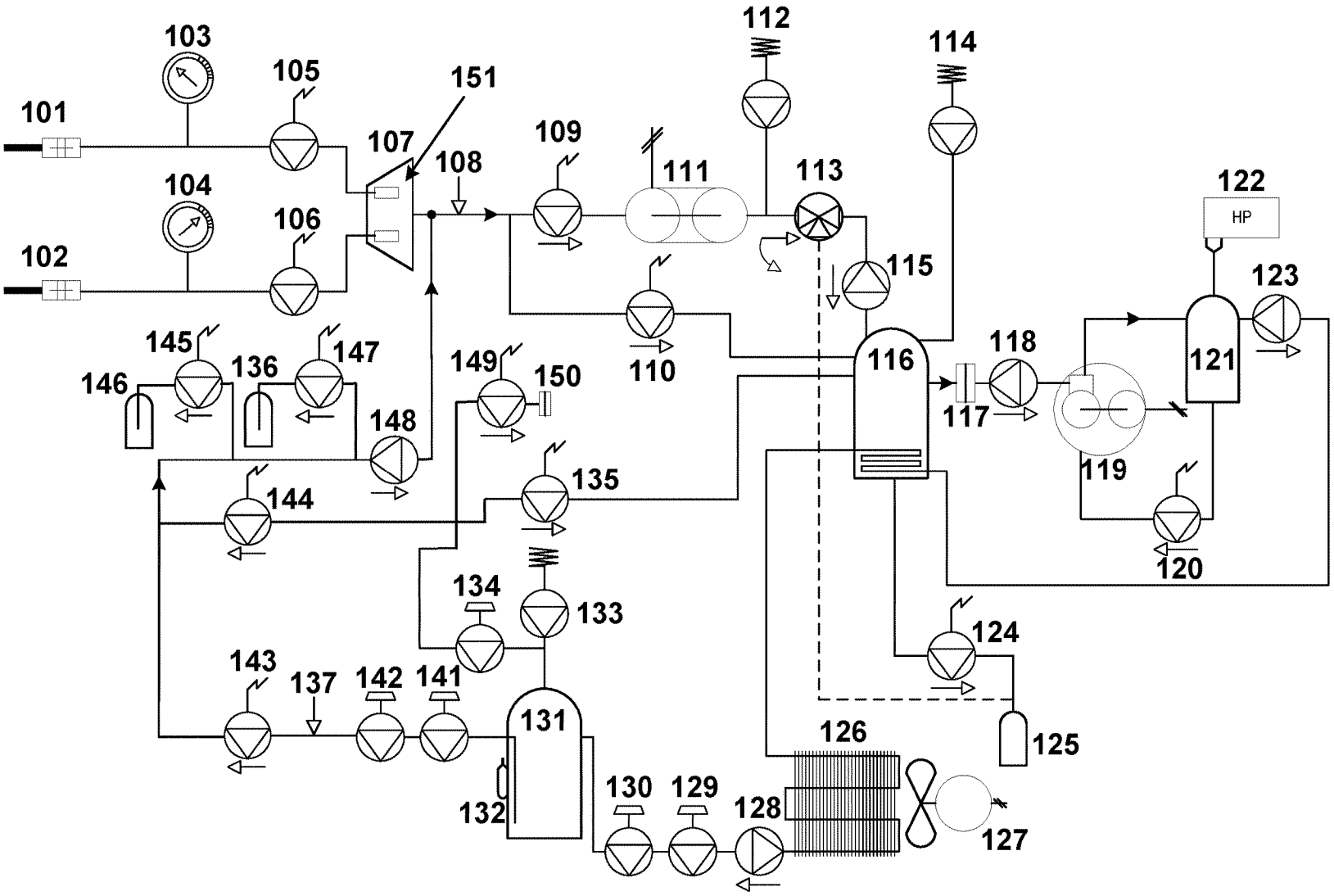
FIG. 4 is a schematic diagram showing example refrigerant plumbing components, according to example embodiments.

The refrigerant plumbing component 27 can comprise one or more plumbing components. FIG. 4 illustrates examples of the refrigerant plumbing component 27, and the used oil storage container 125, the RST 131, and the new oil storage container 136. FIG. 4 also illustrates lines in between components of the RRS 11 to represent fluid connections via plumbing lines. The arrowheads overlaying the lines represent a possible direction of fluid flow. Various subsets of the components shown in FIG. 4 can be controlled by the processor 20, such as by executing the CRPI 41.

The symbols indicated with references numerals 101 and 102 represent a low pressure fitting and a high pressure fitting, respectively. The low pressure fitting 101 and the high pressure fitting 102 can be removably connected to the cooling system 12. The refrigerant within the cooling system 12 can be a liquid, a gas, or a combination of both. Further, the refrigerant can be a liquid, a gas, or a combination of both when the refrigerant is removed from the cooling system 12 at the low pressure fitting 101 or the high pressure fitting 102.

The low pressure fitting 101 and the high pressure fitting 102 permit fluid communication between the RRS 11 and the cooling system 12. The low pressure fitting 101 can be connected to the low pressure side of the device within the cooling system 12 that contains refrigerant. Similarly, the high pressure fitting 102 can be connected to the high pressure side of the device within the cooling system 12 that contains refrigerant. The low pressure fitting 101 or the high pressure fitting 102 can be connected to the respective side of the device within the cooling system 12 that contains refrigerant at a port within the device, for example. The low pressure fitting 101 and the high pressure fitting 102 can be male or female connectors. For example, the low pressure fitting 101 and the high pressure fitting 102 can be female connectors threaded on the inside to allow for a mating with a male connector on the device within the cooling system 12 that contains refrigerant. Furthermore, the low pressure fitting 101 and the high pressure fitting 102 can be interchangeable components within or at the RRS 11, allowing connections to cooling systems within a wide array of vehicle makes and models, each with a potentially unique air-conditioning unit, for example.

The refrigerant plumbing component 27 can comprise a low-pressure PSD 103 or a high-pressure PSD 104. The low-pressure PSD 103 and the high-pressure PSD 104 can be analog or digital devices. The low-pressure PSD 103 and the high-pressure PSD 104 can output pressure readings to a display of the user interface 22. For example, if the PSD 103 or 104 is an analog manometer, it may output to an analog display, such as a needle overlaying a range of values displayed angularly around the circumference of an arc, like a gauge. Alternatively, the low-pressure PSD 103 and the high-pressure PSD 104 can output pressure readings to a digital display. Such a display can have adjustable settings, such as pressure resolution and displayed pressure units, for example. Additionally or alternatively, the low-pressure PSD 103 and the high-pressure PSD 104 can be connected to the processor 20. The processor 20 can use the readings from the low-pressure PSD 103 and the high-pressure PSD 104 to ensure proper functionality of the low pressure and the high pressure intake portions of the RRS 11, to prevent extreme pressures from damaging portions of the RRS 11, or to provide to a display an indication of the pressure measured by the low-pressure PSD 103 or the high-pressure PSD 104.

The refrigerant plumbing component 27 can comprise a low pressure electronic valve 105 or a high pressure electronic valve 106. The low pressure electronic valve 105 and the high pressure electronic valve 106 can be controlled by the processor. The low pressure electronic valve 105 and the high pressure electronic valve 106 can permit the low pressure intake and the high pressure intake from the cooling system 12 to be shut off, respectively. For example, if the high-pressure PSD 104 transmits a pressure reading to the processor 20 that the processor 20 determines exceeds a pressure threshold within the RRS 11 that may damage the RRS 11, the processor 20 can transmit a signal to close the high pressure electronic valve 106 to prevent such damage from occurring. In alternate embodiments, the electronic valves 105 and 106 can be replaced with manual valves.

The refrigerant plumbing component 27 can comprise a manifold 107. The manifold 107 combines the low pressure and high pressure fluid inputs accessed from the cooling system 12 through the low pressure fitting 101 and the high pressure fitting 102. The manifold 107 can include a mechanical filter fitted to the low pressure intake and the high pressure intake, in some embodiments. The mechanical filter can prevent debris that was present inside of the cooling system from entering the RRS 11. Additionally, the mechanical filter can be replaceable, to ensure that if the mechanical filter no longer permits the transmission of fluid (because it is inundated with debris from previous refrigerant recovery operating states, for example), the mechanical filter can be replaced. Downstream of the manifold 107, fluid that was taken in by the RRS 11 from the cooling system 12 at the high pressure intake and at the low pressure intake will be merged and flow together. The manifold 107 can comprise a mechanical filter 151.

The refrigerant plumbing component 27 can comprise a pressure transducer 108. The pressure transducer 108 can measure a pressure within the RRS 11 at the location of the pressure transducer 108. The measured pressure can provide an absolute pressure measurement (i.e., the measured pressure is compared with an absolute vacuum). The pressure transducer 108 can be connected to the plumbing line via a port, in some embodiments. In alternate embodiments, a pressure switch or a pressure gauge can be used, rather than or in addition to the pressure transducer 108. The pressure transducer 108 can output the measured pressure in the form of a voltage signal, for example, where the voltage value corresponds to the measured pressure. In some example embodiments, the pressure transducer 108 will transmit a signal corresponding to the measured pressure to the processor 20. This transmission can occur wirelessly or wireline.

The refrigerant plumbing component 27 can comprise an electronic inlet valve 109 to a vacuum pump 111. The electronic inlet valve 109 to the vacuum pump 111 can be controlled by the processor 20. For example, the electronic inlet valve 109 to the vacuum pump 111 can be closed during a first phase of a recovery operating state to prevent refrigerant from flowing to the vacuum pump 111, and can be opened during a second phase of the recovery operating state to permit refrigerant to flow to the vacuum pump 111. The electronic inlet valve 109 to the vacuum pump 111 can receive an electronic signal from the processor 20 indicating a change of state for the valve (open when closed or close when open, for example). Such a signal can prompt the electronic inlet valve 109 to the vacuum pump 111 to mechanically open or close to accommodate the instruction from the processor 20.

The refrigerant plumbing component 27 can comprise an electronic inlet valve 110 to an oil evaporator/separator/vacuum chamber 116. The electronic inlet valve 110 to the oil evaporator/separator/vacuum chamber 116 can be controlled by the processor 20. For example, the electronic inlet valve 110 to the oil evaporator/separator/vacuum chamber 116 may be closed during a second phase of the recovery operating state to prevent refrigerant from flowing directly to the oil evaporator/separator/vacuum chamber 116, and can be opened during a first phase of the recovery operating state to permit refrigerant to be diverted around the vacuum pump 111. The electronic inlet valve 110 to the oil evaporator/separator/vacuum chamber 116 can receive an electronic signal from the processor 20 indicating a change of state for the valve (open when closed or close when open, for example). Such a signal can prompt the electronic inlet valve 110 to the oil evaporator/separator/vacuum chamber 116 to mechanically open or close to accommodate the instruction from the processor 20.

In alternate embodiments, both the electronic inlet valve to the vacuum pump 109 and the electronic inlet valve to the oil evaporator/separator/vacuum chamber 110 can be replaced by a single three-way valve that only permits fluid flow to the vacuum pump 111 or to the oil evaporator/separator/vacuum chamber 116.

The refrigerant plumbing component 27 can comprise a vacuum pump 111. The vacuum pump 111 can be controlled external to the RRS 11. Alternatively, the vacuum pump 111 can be controlled by the processor 20. For example, during the first phase of the recovery operating state, the vacuum pump 111 can be disengaged. At the beginning of the second phase of the recovery operating state, the vacuum pump 111 can receive a signal from the processor 20 indicating that the vacuum pump 111 be engaged to assist the compressor in the recovery of refrigerant from cooling system 12. At the conclusion of the second phase of the recovery operating state, the vacuum pump 111 can receive another signal from the processor 20 indicating that the vacuum pump 111 be disengaged to cease assisting the compressor in the recovery of refrigerant from the cooling system 12. Engaging or disengaging the vacuum pump 111 can include providing or removing electrical power to the vacuum pump 111. This can be done by closing or opening electrical relays or electrical switches, in some embodiments.

The vacuum pump 111, mechanically, serves to evacuate fluid, such as gas (e.g., air), from the RRS 11. The vacuum pump 111 can include a vacuum chamber that is evacuated to create a vacuum. Alternatively, the vacuum pump 111 can withdraw fluid from within hoses in the RRS 11. The inherent low pressure created by the vacuum pump 111 creates a pressure difference that aids in the removal of refrigerant from the cooling system 12. The vacuum pump 111 can use additional fluids (e.g., oil) or additional components (e.g., rubber O-rings) to aid in the creation of a seal to generate the vacuum.

The vacuum pump 111 can be a high or an ultra-high vacuum pump, in various embodiments (e.g., the vacuum pump 111 is best suited to evacuate fluid when the pressure in the RRS 11 is at a high or ultra-high vacuum level). In alternate embodiments, the RRS 11 can additionally comprise a roughing pump. Such a roughing pump can be configured to evacuate fluid from the RRS 11 at a higher pressure (e.g., atmospheric pressure or above) until the pressure is sufficiently low (e.g., the pressure is low enough that a high or ultra-high vacuum pump can function). The roughing pump can assist a compressor 119 during a first stage of a refrigerant recovery operating state, in some embodiments. Furthermore, in alternate embodiments, the vacuum pump 111 can comprise a roughing pump in addition to a high or an ultra-high vacuum pump.

The refrigerant plumbing component 27 can comprise a vacuum pump safety valve 112. The vacuum pump safety valve 112 can allow excess fluid to be removed from the system in the case that there is too much fluid (e.g., refrigerant) at the downstream end of the vacuum pump 111. Additionally, if the pressure differential created by the vacuum pump 111 is too great, the vacuum pump safety valve 112 can be opened to allow air to flow into the system to re-stabilize the RRS 11. The vacuum pump safety valve 112 can be configured to automatically open when a certain pressure differential is applied across it. Alternatively, the vacuum pump safety valve 112 can be controlled by the processor 20 (e.g., the processor 20 can transmit electronic signals to the vacuum pump safety valve 112 to instruct the valve to open or close).

The refrigerant plumbing component 27 can comprise a three-way valve 113 that can divert fluid flow from the oil evaporator/separator/vacuum chamber 116 to a used oil container 125. The potential alternate route of fluid flow is represented by a dashed line between the three-way valve 113 and the used oil container 125. The fluid that can flow through this alternate route between the three-way valve 113 and the used oil container 125 can be oil used by the vacuum pump 111 rather than refrigerant recovered from the cooling system 12. For example, after the refrigerant recovery operating state has been initiated a number of times, it may be necessary to empty the oil within the vacuum pump 111 in order to replace it. This can be done by changing the direction of the three-way valve 113 such that the used oil can be diverted to the used oil container 125. The three-way valve 113 can be controlled by the processor 20 (e.g., the processor 20 can transmit electronic signals to the three-way valve 113 to instruct the three-way valve 113 to open or close). Additionally or alternatively, the three-way valve 113 can be accessible by a user of the RRS 11 such that the three-way valve 113 is manually adjustable.

The refrigerant plumbing component 27 can comprise an oil evaporator/separator/vacuum chamber safety valve 114 that can allow excess fluid to be removed from the oil evaporator/separator/vacuum chamber 116 in the case that there is too much fluid (e.g., refrigerant) in the oil evaporator/separator/vacuum chamber 116. Additionally, if the pressure within the oil evaporator/separator/vacuum chamber 116 is too great, some of the fluid within the oil evaporator/separator/vacuum chamber 116 may need to be released. To accomplish this, the oil evaporator/separator/vacuum chamber safety valve 114 can be opened. The oil evaporator/separator/vacuum chamber safety valve 114 can be configured to automatically open when a certain pressure differential is applied across it. Alternatively, the oil evaporator/separator/vacuum chamber safety valve 114 can be controlled by the processor 20 (e.g., the processor 20 can transmit electronic signals to the oil evaporator/separator/vacuum chamber safety valve 114 to instruct the valve to open or close).

The refrigerant plumbing component 27 can comprise a vacuum check valve 115 that ensures that fluid does not flow back from the oil evaporator/separator/vacuum chamber 116 into the vacuum pump 111 during the recovery operating state. Therefore, the vacuum check valve 115 prevents the low pressure generated by the vacuum pump 111 from drawing fluid back into the vacuum pump 111 from portions of the RRS 11 that are downstream of the vacuum pump 111.

The refrigerant plumbing component 27 can comprise the oil evaporator/separator/vacuum chamber. The oil evaporator/separator/vacuum chamber 116 is configured to evaporate the refrigerant within the fluid mixture that is within the oil evaporator/separator/vacuum chamber 116. This can involve heating the fluid mixture to a temperature such that the refrigerant evaporates (i.e., undergoes a phase change from a liquid to a gas), while the rest of the fluids (e.g., oil from the vacuum pump 111) remain in a liquid state (i.e., do not have a high enough temperature so that they also undergo a phase change to a gas). The refrigerant can evaporate in the oil evaporator/separator/vacuum chamber 116 because the pressure in the oil evaporator/separator/vacuum chamber 116 is less than the vapor pressure for the refrigerant. Once the refrigerant is evaporated, it can be separated from the other fluids in the oil evaporator/separator/vacuum chamber 116. For example, the gaseous part of the mixture can be removed from an upper portion of the oil evaporator/separator/vacuum chamber 116. The refrigerant that is removed in a gaseous form can then be sent downstream to the compressor 119 by the oil evaporator/separator/vacuum chamber 116. The oil, currently in a liquid phase, can be then removed from the oil evaporator/separator/vacuum chamber 116 and transmitted downstream to the used oil container 125.

Furthermore, when the vacuum pump 111 is engaged, a vacuum can be generated in the oil evaporator/separator/vacuum chamber 116. This can assist in the separation of the refrigerant from the other fluids, and aid in the recovery of the refrigerant from the cooling system 12. For example, during a second phase of the recovery operating state, the vacuum pump 111 can create a low pressure within the oil evaporator/separator/vacuum chamber 116 to assist the compressor 119 in removing refrigerant from the cooling system 12.

The refrigerant plumbing component 27 can comprise an evaporator filter 117. The evaporator filter 117 can remove any particulates from the gaseous refrigerant mixture, for example. An example evaporator filter 117 is a dense screen. In this way, the evaporator filter 117 can prevent compounds that are not gaseous refrigerant from being transmitted to the compressor 119.

The refrigerant plumbing component 27 can comprise an evaporator check valve 118. The evaporator check valve 118 ensures that fluid does not flow back upstream from the compressor 119 into the oil evaporator/separator/vacuum chamber 116. Therefore, the high pressure generated by the compressor 119 cannot force fluid back into the oil evaporator/separator/vacuum chamber 116.

The refrigerant plumbing component 27 can comprise the compressor 119. The compressor 119 serves to compress the gaseous refrigerant and any remaining contaminants (i.e., increase the pressure of the gaseous refrigerant and any remaining contaminants by reducing the volume of the gaseous refrigerant and any remaining contaminants). This mixture of gaseous refrigerant and trace contaminants (e.g., oil from the compressor) is then transported downstream by the compressor 119 to an oil separator 121. The compressor 119 can be engaged by the processor 20 during the recovery operating state to remove refrigerant from the cooling system 12. Engaging the compressor 119 can include providing electrical power to the compressor 119. This can be done by closing electrical relays or electrical switches, in some embodiments. The compressor 119 may remove refrigerant from the cooling system 12 during the recovery operating state process by pulling it from the cooling system 12. For example, as a piston is pulled in one direction within the compressor 119, a low pressure can be created within the compressor 119. This low pressure can serve to suck fluid into the compressor 119 through a suction port, in some embodiments. This suction force can be propagated down the plumbing lines of the RRS 11 back to the cooling system 12, thereby pulling fluid from the cooling system 12.

The refrigerant plumbing component 27 can comprise an electronic valve 120 for adding oil within the compressor 119. Oil that is recovered by the oil separator 121 can be transported to the compressor 119 to refill the compressor 119 allowing the compressor 119 to continue compressing gases. The electronic valve 120 for refilling oil within the compressor 120 can be opened to allow for the oil to enter the compressor 119. The opening and closing of the electronic valve 120 for refilling oil within the compressor 119 may be controlled by the compressor 119, in some embodiments. In other embodiments, the electronic valve 120 for refilling oil within the compressor 119 can be controlled by the processor 20 (e.g., the processor 20 can transmit electronic signals to the electronic valve 120 for refilling oil within the compressor 119 to instruct the valve to open or close). This can be done by the processor 20 in response to an oil level reading that was transmitted to the processor 20 by the compressor 119.

The refrigerant plumbing component 27 can comprise the oil separator 121. The oil separator 121 again separates oil from within the gaseous refrigerant/oil mixture. The oil separator 121 thus serves to increase the concentration of refrigerant within the fluid mixture. The oil separated from the gaseous refrigerant/oil mixture can be transported back to the compressor 119. In addition, the fluid mixture, now with a more purified refrigerant concentration, is transported downstream to a condenser 126.

The refrigerant plumbing component 27 can comprise a safety pressure switch 122. To ensure the oil separator 121 does not experience a pressure that is too extreme for the oil separator 121 to function properly (e.g., without being destroyed), the safety pressure switch 122 can be present. The safety pressure switch 122 can trigger in response to reading a pressure that is above a certain safety pressure threshold. Alternatively, the safety pressure switch 122 can trigger in response to detecting a difference between an exterior pressure (e.g., atmospheric pressure) and a pressure inside the oil separator 121 meets or exceeds a pressure threshold. When the safety pressure switch 122 triggers, the compressor 119 can be disengaged, in some embodiments. This can occur, for example, by the safety pressure switch 122 transmitting an electronic signal to the compressor 119. In alternate embodiments, the safety pressure switch 122, upon triggering, can transmit an electronic signal to the processor 20.

The refrigerant plumbing component 27 can comprise a check valve 123 that prevents fluid from flowing back into the oil separator 121 after leaving the oil separator 121.

The refrigerant plumbing component 27 can comprise an electronic oil discharge valve 124. The electronic oil discharge valve 124 allows fluid from the oil evaporator/separator/vacuum chamber 116 to be discharged to the used oil container 125. The electronic oil discharge valve 124 can be controlled remotely by an end user, in some embodiments. Alternatively, the processor 20 can control the electronic oil discharge valve 124 (e.g., the processor 20 can transmit electronic signals to the electronic oil discharge valve 124 to instruct the valve to open or close).

The refrigerant plumbing component 27 can comprise the condenser 126. The condenser 126 condenses fluids (i.e., transforms the fluid from a gaseous phase to a liquid phase by reducing the temperature of the fluid). The fluid that is transmitted through the condenser 126 can be comprised of mostly refrigerant, in some embodiments. The condenser 126 can comprise many coils, thereby increasing the surface area to volume ratio of the condenser 126 to increase the heat lost by the fluid to the surrounding environment.

The refrigerant plumbing component 27 can comprise an electric fan. The electric fan 127 can serve to cool the condenser 126. The condenser 126 can be cooled by the electric fan 127 such that it the temperature within the condenser 126 is low enough to condense the refrigerant that was removed from the cooling system 12.

The refrigerant plumbing component 27 can comprise a check valve 128 that prevents fluid that leaves the condenser 126 from reentering the condenser 126.

The refrigerant plumbing component 27 can comprise manual valves 129, 130, 141, or 142. The manual valves 129, 130, 141, or 142 can be opened or closed externally be a user of the RRS 11, in some embodiments. One, any or all of the manual valves 129, 130, 141, or 142 can be three-way valves, in some embodiments, allowing for refrigerant to be tapped and retrieved at the location of the manual valves. This can occur as the refrigerant flows downstream from the condenser 126 during the recovery operating state. Alternatively, this can allow for refrigerant to be retrieved from the RST 131 during or after the recovery operating state.

The refrigerant plumbing component 27 can comprise a refill electronic valve 143 controllable by the processor 20 to allow refrigerant from the RST 131 to flow to the cooling system 12 when the manual valves 141 and 142 are open.

The refrigerant plumbing component 27 can comprise an end fill refrigerant electronic valve 144. The processor 20 can control the end fill refrigerant electronic valve 144 to allow refrigerant that has passed out of the RFT 131 to return to the RFT 131.

The refrigerant plumbing component 27 can comprise a dye tracer container 146 and a dye tracer electronic valve 145. The dye tracer container 146 to store the dye that can be released into the cooling system 12 in order to inspect the cooling system 12 for leaks. The processor 20 can control the dye tracer electronic valve 145 to release the dye tracer into the plumbing lines connected to the cooling system 12.

The refrigerant plumbing component 27 can comprise an air purge filter 150 and an air purge electronic valve 149. The processor 20 can control the air purge electronic valve 149 to release a fluid in the plumbing line connected to the air purge electronic valve 149 into the air purge filter 150.

The refrigerant plumbing component 27 can comprise a check valve 148 that prevents fluid destined for the cooling system 12 to renter the RST 131 directly.

The refrigerant plumbing component 27 can comprise a storage tank temperature probe. The storage tank temperature probe 132 can have an analog or digital display that is legible by users of the RRS 11, in some embodiments. Additionally or alternatively, the storage tank temperature probe 132 can transmit temperature measurements to the processor 20. The temperature within the RST 131 can indicate whether the refrigerant within the storage tank is in a gaseous or a liquid state.

The refrigerant plumbing component 27 can comprise an electronic storage tank safety valve 133. The electronic storage tank safety valve 133 can allow excess fluid to be removed from the RST 131 in the case that there is too much fluid (e.g., refrigerant) in the RST 131. Additionally, if the pressure within the RST 131 is too great, some of the fluid within the RST 131 may need to be released. To accomplish this, the electronic storage tank safety valve 133 can be opened. The electronic storage tank safety valve 133 can be configured to automatically open when a certain pressure differential is applied across it. Alternatively, the electronic storage tank safety valve 133 can be controlled by the processor 20 (e.g., the processor 20 can transmit electronic signals to the electronic storage tank safety valve 133 to instruct the valve to open or close).

The refrigerant plumbing component 27 can comprise a manual valve 134. The manual valve 134 can be opened or closed externally be users of the RRS 11, in some embodiments. The manual valve 134 can be a three-way valve, in some embodiments, allowing for refrigerant to be retrieved from the RST 131 during or after the recovery operating state. The manual valve 134 can also be closed to prevent fluid within the RST 131 from flowing to the oil evaporator/separator/vacuum chamber 116.

The refrigerant plumbing component 27 can comprise an electronic evaporator overpressure valve 135. The electronic evaporator overpressure valve 135 can have an associated pressure threshold. If the pressure on the electronic evaporator overpressure valve 135 is greater than the associated pressure threshold, the electronic overpressure valve 135 can open to allow fluid to flow from the RST 131 to the evaporator/separator/vacuum chamber 116. The associated pressure threshold can be set remotely by a user of the RRS 11, in some embodiments. In alternate embodiments, the associated pressure threshold can be set by the processor 20. Alternatively, the electronic evaporator overpressure valve 135 can include a pressure transducer and a transmitter that transmits the pressure measured by the included pressure transducer to the processor 20. The processor 20 can then determine if the measured pressure exceeds a threshold value. If the measured pressure does exceed a threshold value, the processor 20 can transmit electronic data to the electronic evaporator overpressure valve 135 instructing it to open. If the measured pressure does not exceed a threshold value, the processor 20 can transmit electronic data to the electronic evaporator overpressure valve 135 instructing it to close.

The refrigerant plumbing component 27 can comprise an additional component for filling or monitoring vehicle refrigerant. In some embodiments, the additional component for filling or monitoring vehicle refrigerant can include check valves, manual valves, electronic control valves, filters, and pressure transducers. Additionally, the additional component for filling or monitoring vehicle refrigerant can include a container of tracer dye. The tracer dye can be injected into an air-conditioning system of the cooling system 12, for example, through the low pressure fitting 101 or the high pressure fitting 102. Following a path traced out by the tracer dye within the cooling system 12 can allow the identification of leaks within the cooling system 12, for instance.

Next, FIG. 5 is a front-view illustration of an RRS 60 configured to recover refrigerant from the cooling system 12, according to example embodiments. The RRS 60 can operate as the RRS 11 shown in FIG. 1. The RRS 60 can comprise the RRS 19 or any subset of components of the RRS 19 shown in FIG. 2, FIG. 3, or FIG. 4. The RRS 60 includes a chassis 61, two or more wheels 62, an access door 63, an RST 64, one or more plumbing components 65, a status light 77, and a user interface 78. The RRS 60 can be capable of meeting a Society of Automotive Engineers (SAE) certification standard set by the Environmental Protection Agency (EPA) of recovering 3 lbs. of refrigerant in thirty minutes from a 2010 Chevrolet Suburban®.

The chassis 61 can house multiple components of the RRS 60. For example, the chassis 61 can house the one or more plumbing components 65 (e.g., valves, tubes, a vacuum pump, a compressor, a refrigerant hose 86 or refrigerant oil hoses 66 and 67). In addition, the chassis 61 houses the RST 64. The chassis 61 can further house electronic components, such as a processor that interacts with the user interface 78. The chassis 61 can also house a power supply, such as a battery or a converter that can be electrically connected to a standard outlet. The chassis 61 can comprise a shelf (e.g., a shelf 68 and a shelf 69) to separate different components housed within the chassis 61. Alternatively or additionally, the chassis 61 can comprise a mounting bracket 70 to which one or more components of the RRS 60 are mounted.

The RRS 60 comprises a new refrigerant oil container 74 and a used refrigerant oil container 75. The RRS 60 comprises a scale 71 for weighing content of the RST 64, a scale 72 for weighing content of the new refrigerant oil container 74, and a scale 73 for weighing content of the used refrigerant oil container 75. The refrigerant hose 86 is removably connected to the RST 64. The refrigerant oil hoses 66 and 67 are removably connected to the used refrigerant oil container 75 and the new refrigerant oil container 74, respectively. The scale 71 can comprise or be arranged as the scale 23. The scale 72 can comprise or be arranged as the scale 24. The scale 72 can comprise or be arranged as the scale 73.

The two or more wheels 62 enable the RRS 60 to be rolled from one location to another within a shop or a garage, for example. In some embodiments, the wheels can have two rotational degrees of freedom (e.g., casters). In the example embodiment of FIG. 5, the RRS 60 comprises four wheels, two in the front and two in the back.

The access door 63 can be a hinged piece of metal or plastic. Alternatively, as shown in FIG. 5, the access door 63 can be made of a transparent material, such as poly(methyl methacrylate) (PMMA). The access door 63 can permit a user to inspect components of the RRS 60 to troubleshoot the RRS 60 if it is not in working order. Furthermore, the access door 63 can be closed to prevent interference with the components of the RRS 60 or contamination of the fluids within the RRS 60. The access door 63 can be lockable, in some embodiments.

The RST 64 can comprise or be configured as the RST 131 shown in FIG. 2 and FIG. 4. The RST 64 can be pressurized, in some embodiments, to maintain the recovered refrigerant in a gaseous state, for example. In some embodiments, the RST 64 can be temperature/climate controlled within the RRS 60. The used refrigerant oil container 75 can comprise or be configured as the used refrigerant oil container 125 shown in FIG. 2 and FIG. 4. The new refrigerant oil container 74 can comprise or be configured as the new refrigerant oil container 136 shown in FIG. 2 and FIG. 4.

The one or more plumbing components 65 serve as interconnects between components within the RRS 60. The one or more plumbing components 65 can comprise one or more of the components shown in FIG. 4, for example.

The user interface 78 can facilitate the interaction of the RRS 60 with a human or non-human user, such as to receive input from a user and to provide feedback to the user. The user interface 78 can also allow a user to input data during a "user input required" status of the RRS 60. Such input, once processed by the processor 20, can cause initiation of an operating state of the RRS 60 different than the current operating state of the RRS 60.

The user interface 78 can comprise the UI 22 (shown in FIG. 2). The UI 78 can comprise UI input components. As an example, the UI input components can comprise a power switch 82 to turn the RRS 60 on or off, a fill RST selector switch 83, a recharge refrigerant selector switch 84, a recover refrigerant selector switch 85, and a keypad 86. As another example, the UI input components can comprise a keyboard, a joystick, a microphone, a still camera, or a video camera. As another example, the UI input components can comprise a touch-sensitive or presence-sensitive panel, which can be located within a display screen 81.

The user interface 78 can comprise UI output components such as a display screen 81 (which, for example, can be combined with a presence-sensitive panel (i.e., a touch-screen)), a cathode ray tube (CRT), a liquid crystal display (LCD), an LED-based display, a display using digital light processing (DLP®) technology, a light bulb, or one or more other similar devices, now known or later developed. The UI output components can comprise analog gauges 79 and 80 that are adapted to indicate pressures within different plumbing components of the RRS 60. The user interface 78 can also be configured to generate audible output(s), via a speaker, speaker jack, audio output port, audio output device, earphones, or other similar devices, now known or later developed in the future. The outputs of the user interface 78 can be controlled by the processor 20 and the inputs from the user interface 78 can be transmitted to the processor 20.

The user interface 78 can comprise a status light 77. The status light 77 can be configured to indicate a determined current status of an operating state of the RRS 60, such as a status of the recovery operating state. The status light 77 can be controlled by the processor 20. In some embodiments, the status light 77 can be visible from 360 degrees around the RRS 60 from the horizontal plane projected outward in all directions from the status light 77. The status light can emit a single frequency of light such that the status light comprises a single color light. Alternatively, the status light 77 emit multiple different frequencies of light such that the status light comprises a multiple color light. For example, the status light 77 can be green and illuminated by the processor 20 when the RRS 60 status is "ready", the status light 77 can be yellow and illuminated by the processor 20 when the RRS 60 status is "in progress", and the status light 77 can be red and illuminated by the processor 20 when the RRS 60 status is "user input required". Thus, the location of the illuminated status light and the respective color would each indicate to a user the current status of the RRS 60. In addition to "ready", "in progress", and "user input required", multiple other possible statuses can be indicated by additional colors, illumination patterns, or individual status lights. In alternate embodiments, the status light 77 can change its color based on the status of the RRS 60 or change a frequency at which it flashes based on the status of the RRS 60.

The status light 77 can comprise multiple status lights. At least one of the status lights can be viewable from 360 degrees around the RRS 60 as described above. The processor 20, for example, can determine a status of a current operating state of the RRS 60 and output a signal to illuminate at least one of the multiple status lights. The determined status of the recovery operating state can be based on the current phase of a multiple phase recover refrigerant operating state. Alternatively, the determined status may be based on a current pressure with a component of the RRS 60, the current fill level of the RST 64, the current temperature of the RST 64, etc. Furthermore, the determined status can be an in-progress status, a ready status, or a user input required status. The illuminated status light can correlate to the determined current status of the operating state of the RRS 60.

Figure 6:
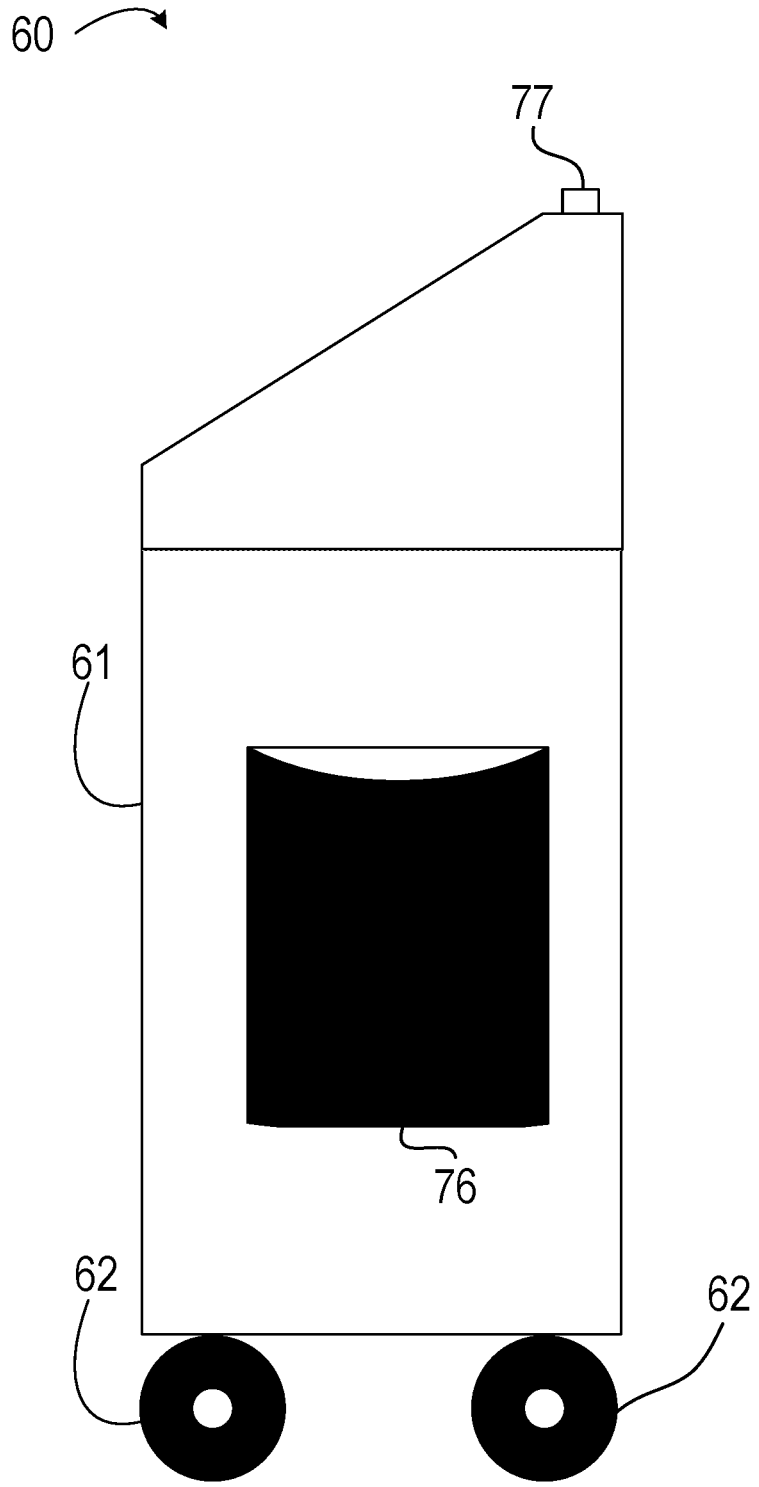
FIG. 6 is a side-view illustration of the refrigerant recovery system shown in FIG. 5.

Next, FIG. 6 is a side-view illustration of the RRS 60 configured to recover refrigerant from the cooling system 12, according to example embodiments. As shown in FIG. 6, the RRS 60 comprises the chassis 61, the two or more wheels 62 (in this embodiment, there are four wheels), and the status light 77. In addition, the side-view illustration of FIG. 6 shows a pocket 76.

The pocket 76 can be configured to hold plumbing components for use with the RRS 60. For example, the RRS 60 can require hoses and connectors to enable connection of the RRS 60 to vehicles of different types (e.g., specific male or female connectors on the ends of hoses to connect to the high or low pressure fittings of different vehicle types). When not in use, these plumbing components can be stored in the pocket 76 such that they would be readily accessible when required.

FIG. 7 is an illustration of the RRS 60 configured to recover refrigerant from a vehicle fluidly connectable to the vehicle 95, according to example embodiments. The RRS 60 is the same RRS 60 as illustrated in FIG. 5 and FIG. 6 (shown in FIG. 7 from the back). For instance, FIG. 7 shows the two or more wheels 62 and the status light 77 of the RRS 60. The RRS 60 is connected to a cooling system 96 adapted to store refrigerant within the vehicle 95. The cooling system 96 comprises a low side hose 97, a low side coupler 98, a high side coupler 100, and a high side hose 99. The portion of the vehicle 95 illustrated in FIG. 7 can be located underneath the hood of the vehicle 95, for example, among other components of the vehicle 95.

The high side coupler 100 and the low side coupler 98 can be equivalent to, for example, the high pressure fitting 102 and the low pressure fitting 101, respectively, illustrated in FIG. 4. The high side coupler 100 and the low side coupler 98 can be female connectors, as illustrated in FIG. 7. The high side coupler 100 can be connected to the RRS 60 through the high side hose 99. The low side coupler 98 can be connected to the RRS 60 through the low side hose 97.

III. Example Notifications

Figure 8:
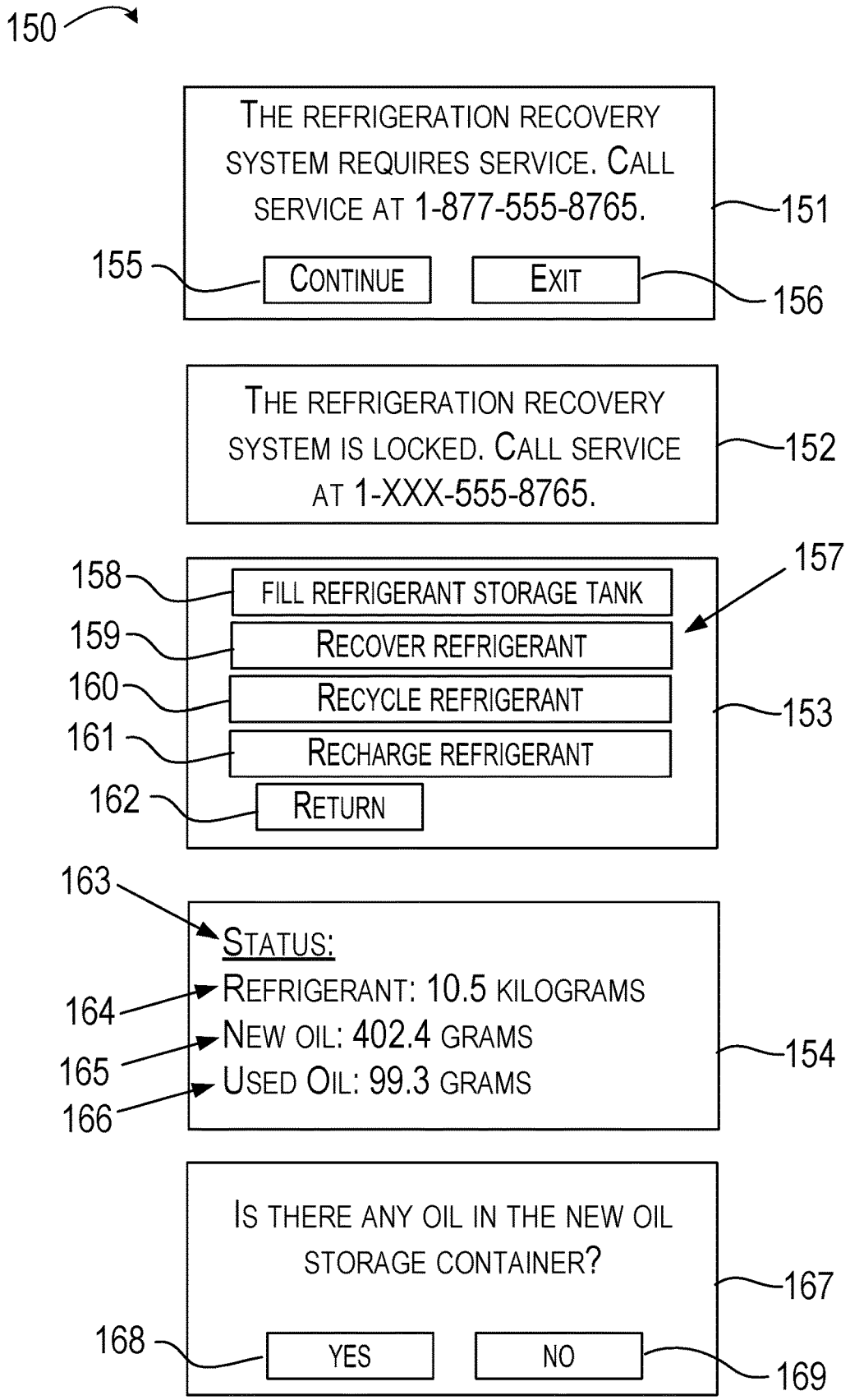
FIG. 8 is an illustration of notifications, according to example embodiments.

Next, FIG. 8 illustrates example notifications 150. The example notifications comprise notifications 151, 152, 153, 154 and 167. The notification 43 (shown in FIG. 3) can comprise one or more of the notifications 151, 152, 153, 154, 167 or a notification based on one of the notifications 151, 152, 153, 154, or 167. The processor 20 can determine when each notification is to be output to the display 81. A notification can comprise a selection segment. The processor 20 can detect the selection segment has been selected and carry out a function associated with the selection segment. Selection of the selection segment can occur by a pointer device or by touching a portion of a touch screen display at which the selection segment is displayed. As an example, the notification 151 comprises a selection segment 155 selectable to continue with an operating state in which the notification 151 is displayed or a selection segment 156 selectable to exit the operating state in which the notification 151 is displayed.

The notification 151 comprises a textual notification that the processor 20 outputs and the display 81 displays when the processor 20 determines the RRS 60 requires service but does not require locking the RRS 60.

The notification 152 comprises a textual notification that the processor 20 outputs and the display 81 displays when or in response to the processor 20 determining the RRS 60 requires service and should be locked.

The notification 153 comprises a textual notification of operating states of the RRS 60 that can be selected using the user interface 78 or via the selection segment section 157 of the notification 153. As an example, the selection segment section 157 can comprise a selection segment 158 selectable to initiate the fill refrigerant storage tank operating state, a selection segment 159 selectable to initiate the recover refrigerant operating state, a selection segment 160 selectable to initiate the recycle refrigerant operating state, a selection segment 161 to initiate the recharge refrigerant operating state, a selection segment 162 to return to a prior notification or aspect displayed by the display 81.

The notification 154 comprises a textual notification of a status 163 of one or more components of the RRS 60. As an example, the status notification 163 can comprise a status notification 164 indicative of the weight of content in the RST 64, a status notification 165 indicative of the weight of content in the new oil storage container 74, or a status notification 166 indicative of the weight of content in the used oil storage container 75. Other examples of the status 163 are also possible.

The notification 167 comprises a textual notification that the processor 20 outputs and the display 81 displays when the processor 20 prompts a user to input indicative of whether or not there is any oil in the new oil storage container (e.g., the new oil storage container 74 or 136). The notification 167 comprise a selection segment 168 selectable to indicate that there is oil in the new oil storage container and a selection segment 169 selectable to indicate that no oil is in the new oil storage container.

IV. Example Operation

Figure 9:
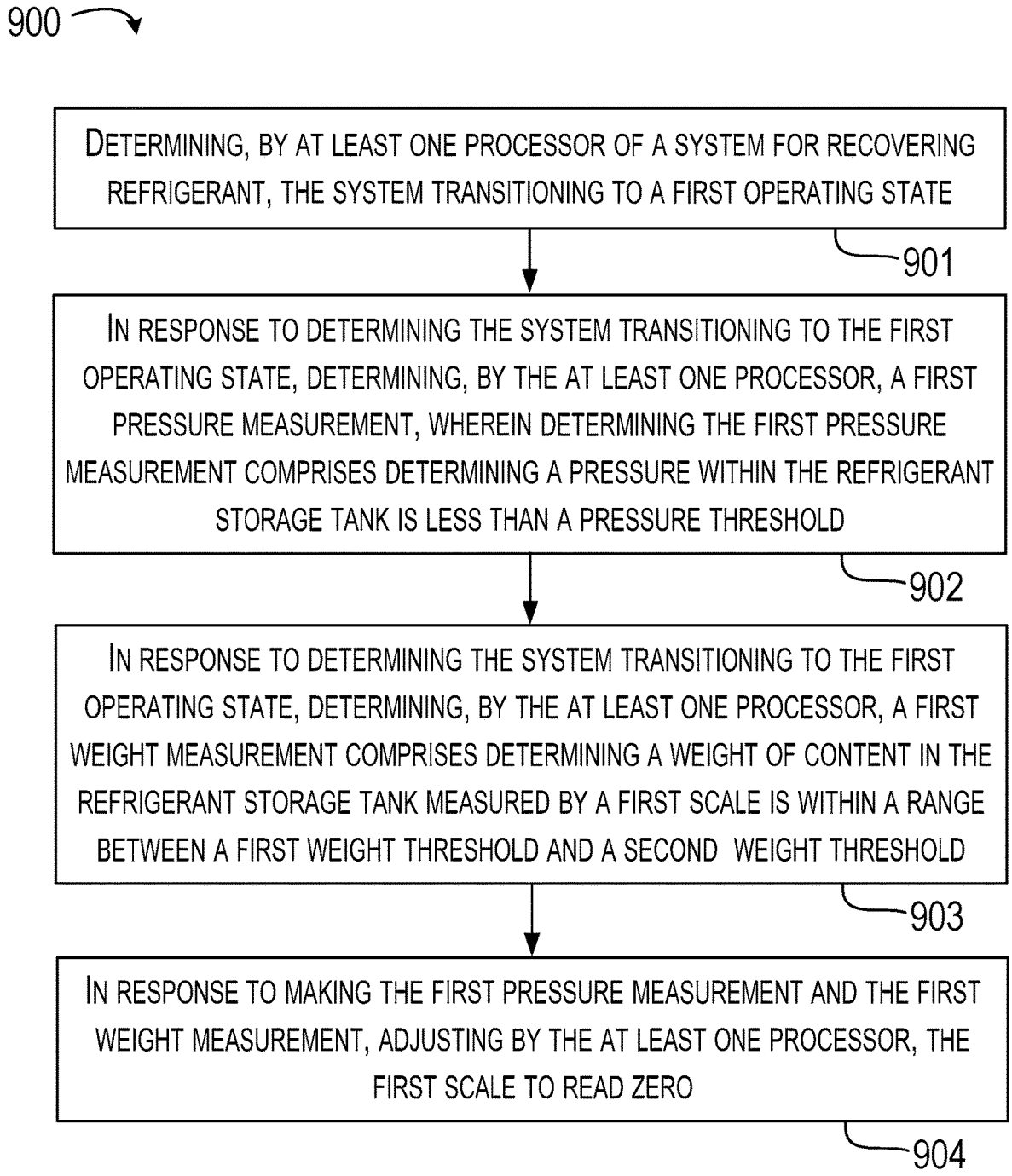
FIG. 9, FIG. 10, FIG. 11, FIG. 12, FIG. 13, FIG. 14, and FIG. 15 are flow charts of a method, according to example embodiments.

Next. FIG. 9 shows a flowchart depicting a set of functions 900 (or more simply "the set 900") that can be carried out in accordance with the example embodiments described in this description. For example, the set 900 can be performed by the RRS 11, 19, or 60. The set 900 includes the functions shown in blocks labeled with whole numbers 901 through 904 inclusive. The following description of the set 900 includes references to elements shown in other figures described in this description, but the functions of the set 900 are not limited to being carried out only by the referenced elements. A variety of methods can be performed using all of the functions shown in the set 900 or any subset of the functions shown in the set 900. Any of those methods can be performed with other functions such as one or more of the other functions described in this description.

Block 901 includes determining, by the processor 20, the RRS 11, 19 or 60 transitioning to a first operating state. As an example, the first operating state can comprise a power on operating state. The processor 20 can determine the RRS 11, 19 or 60 is transitioning to the power on operating state by determining an electrical level (such as a current or voltage level) above a threshold level (e.g., 0.0 amperes or 0.0 volts) is received on an input pin of the processor 20. The processor 20 can determine the RRS 11, 19 or 60 is transitioning to the power on operating state by determining the power switch 82 has been pressed.

As another example, the first operating state can comprise a software reset operating state. The processor 20 can determine the system is transitioning to the software reset operating state by determining a certain portion of computer-readable program instructions is being executed or has just completed being executed.

As another example, the first operating state can comprise a fill refrigerant storage tank operating state. The processor 20 can determine the system is transitioning to the fill refrigerant storage tank operating state by determining the fill RST selector switch 83 has been pressed, for example.

As another example, the first operating state can comprise a recover refrigerant operating state. The processor 20 can determine the system is transitioning to the recover refrigerant operating state by determining the recover refrigerant selector switch 85 has been pressed, for example.

As another example, the first operating state can comprise a recycle refrigerant operating state. The processor 20 can determine the system is transitioning to the recycle refrigerant operating state by determining the selection segment 160 selectable to initiate the recycle refrigerant operating state has been pressed from the notification 153, for example.

As another example, the first operating state can comprise a recharge refrigerant operating state. The processor 20 can determine the system is transitioning to the recharge refrigerant operating state by determining the recharge refrigerant selector switch 84 has been pressed, for example.

Next, block 902 comprises in response to determining the RRS 11, 19 or 60 transitioning to the first operating state, determining, by the processor 20, a first pressure measurement, wherein determining the first pressure measurement comprises determining a pressure within the RST 131 is less than a pressure threshold (e.g., the pressure threshold 47). As an example, the processor 20 can receive, from the PSD 137, an electrical signal indicative of the first pressure measurement or from which the first pressure measurement can be derived. The processor 20 can perform a mathematical operation (for example, determining a ratio or a difference) using the first pressure measurement and the pressure threshold 47 to determine the pressure within the RST 131 is less than the pressure threshold 47.

In a first respect, the pressure threshold 47 can be specified without reference to a vapor pressure. For example, the pressure threshold 47 can be about 345 millibar. As an example, about 345 millibar can be a value between 345 millibar±50 millibar (i.e., a value between 295 millibar to 395 millibar, inclusive). As another example, about 345 millibar can be a value between 345 millibar±10 percent (i.e., a value between 310.5 millibar to 379.5 millibar, inclusive). As another example, the pressure threshold 47 is between 0.0 bar and 2.1 bar. As another example, the pressure threshold 47 can be 5.0 PSI or about 5.0 PSI. About 5.0 PSI can be a value between 3.0 PSI to 7.0 PSI. As still yet another example, the pressure threshold 47 can comprise a value between 0.0 PSI and 30.0 PSI. The pressure threshold 47 can be based, in part, upon a capacity of the RST 131. Other examples of the pressure threshold 47 are also possible.

In a second respect, the pressure threshold 47 can be specified with respect to a vapor pressure. For example, the pressure threshold 47 can be a pressure below a vapor pressure in the RST 131 at an ambient operating temperature of the RRS 11. In accordance with this example embodiment and any other described embodiment, an RRS can comprise a temperature sensor that provides to the processor 20 an electrical signal representative of the ambient operating temperature of the RRS. The temperature determined by the processor 20 can be stored as the system ambient operating temperature 44.

Next, block 903 comprises in response to determining the RRS 11, 19 or 60 transitioning to the first operating state, determining by the processor 20, a first weight measurement, wherein determining the first weight measurement comprises determining a weight of content in the RST 64 or 131 by the scale 71 or 23 is within a range between a first weight threshold and a second weight threshold. Determining the weight of the content in a container can comprise subtracting a tare weight of the container from a weight measurement from a scale weighing that container.

As an example, the first weight threshold is about −13.0 kg. As an example, about −13.0 kg can be a value between −13.0 kg±2.0 kg (i.e., a value between −11.0 kg to −15.0 kg, inclusive). As another example, about −13.0 kg can be a value between −13.0 kg±10 percent (i.e., a value between −11.7 kg to −14.3 kg, inclusive). As yet another example, the first weight threshold can be −29.0 pounds. As still yet another example, the first weight threshold is less than zero and greater than a number equal to negative fifty percent of a capacity of the first scale. The capacity of a scale could be specified in kilograms, pounds or some other units such that the first weight threshold is also specified in kilograms, pounds or some other units. Other examples of the first weight threshold are also possible.

As an example, the second weight threshold is about 13.0 kg. As an example, about 13.0 kg can be a value between 13.0 kg±2.0 kg (i.e., a value between 11.0 kg to 15.0 kg, inclusive). As another example, about 13.0 kg can be a value between 13.0 kg±10 percent (i.e., a value between 11.7 kg to 14.3 kg, inclusive). As yet another example, the second weight threshold can be 29.0 pounds. As still yet another example, the second weight threshold is greater than zero and less than a number equal to positive fifty percent of the capacity of the first scale. Other examples of the second weight threshold are also possible.

Next, block 904 comprises in response to making the first pressure measurement and the first weight measurement, adjusting by the processor 20, first the scale 23 or 71 to read zero. As an example, the processor 20 can adjust the first scale by changing the scale reading 52 for the first scale to read a value representative of zero. A scale reading of zero could be displayed on the display 81 in various ways such as 0, 0.0, or 0.00, for example. As another example, the processor 20 can adjust the first scale by associating a signal level currently provided by the first scale with a weight value of zero.

Next. FIG. 10, FIG. 11, FIG. 12, FIG. 13, FIG. 14, and FIG. 15 show flowcharts depicting sets of functions 940, 941, 942, 943, 944, and 945, respectively. The sets of functions 940, 941, 942, 943, 944, and 945 can be carried out in accordance with the example embodiments described in this description. For example, the sets of functions 940, 941, 942, 943, 944, and 945 can be performed by the RRS 11, 19, or 60. As another example, the sets of functions 940, 941, 942, 943, 944, and 945 can be carried out in combination or independent of the set of functions 900. The following description of the sets of functions 940, 941, 942, 943, 944, and 945 includes references to elements shown in other figures described in this description, but the functions of the sets of functions 940, 941, 942, 943, 944, and 945 are not limited to being carried out only by the referenced elements.

Figure 10:
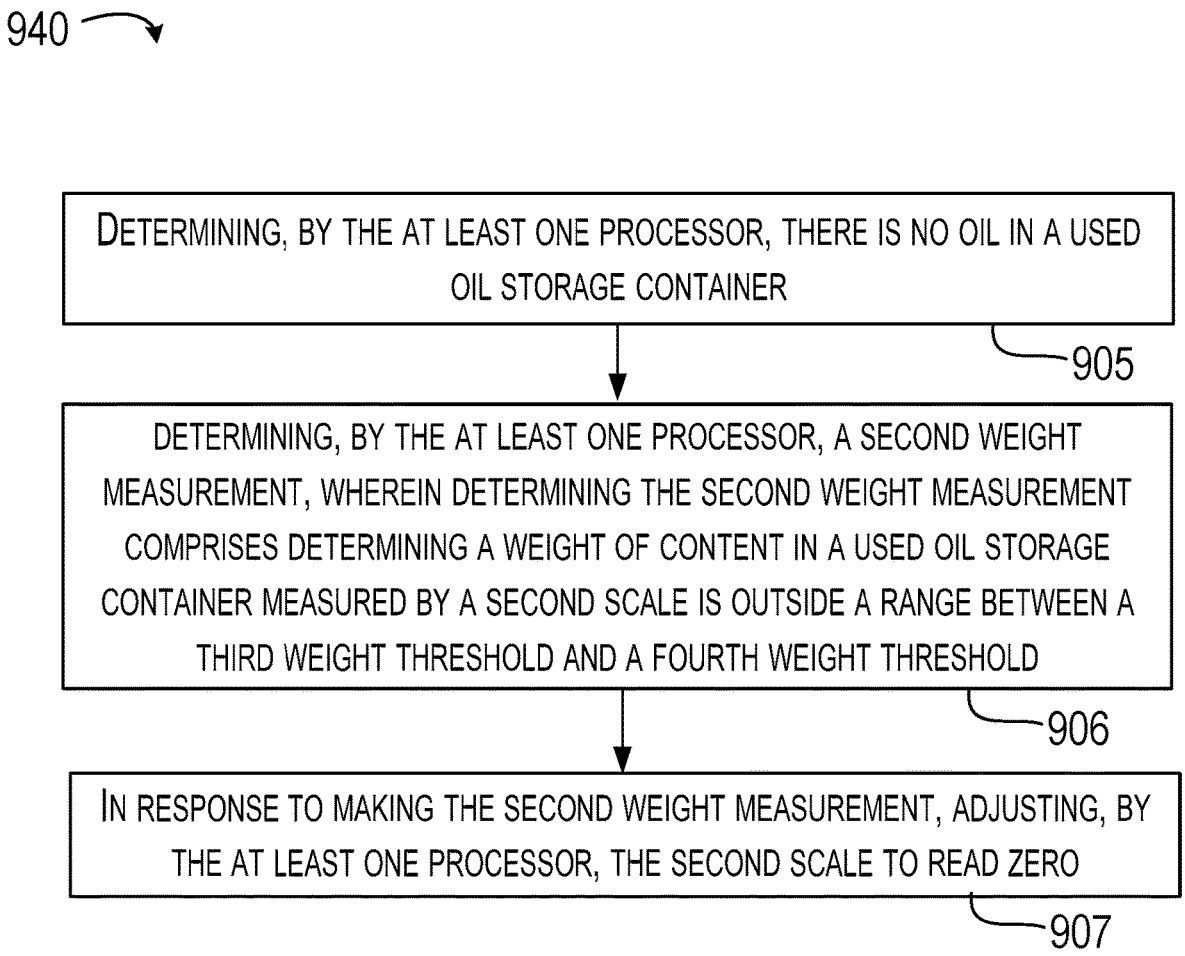

Turning to FIG. 10, the set of functions 940 comprises the functions of blocks 905, 906, and 907. As an example, the RRS 11, 19, or 60 can perform the set of functions 940 in combination with the set of functions 900 when the first operating state of block 901 is the fill refrigerant storage tank operating state.

Block 905 includes determining, by the processor 20, there is no oil in a used oil storage container (e.g., the used oil storage container 75 or 125). In other words, the processor 20 can determine the used oil storage container is empty. As an example, the processor 20 can receive input data from the user interface 78 indicative that there is no oil stored in the used oil storage container. As another example, the processor 20 can refer to data stored in the counters 51 to determine whether or not there is any oil in the used oil storage container. The data used by the processor 20 determine the used oil storage container is empty can indicate a quantity of refrigerant recovered by the RRS (e.g., the RRS 11, 19, or 60) during a lifetime of the RRS is less than an amount of refrigerant indicative of any refrigerant having been added to the refrigerant storage tank (e.g., the RST 64 or 131). The processor 20 can determine the quantity by reading the lifetime recovery counter stored in the counters 51. As an example, the amount of refrigerant indicative of any refrigerant having been added to the refrigerant storage tank can be any amount greater than 0.0 kg. As another example, the amount of refrigerant indicative of any refrigerant having been added to the refrigerant storage tank can be 1.0 kg. As yet another example, the amount of refrigerant indicative of any refrigerant having been added to the refrigerant storage tank can be 2.0 pounds. In an alternative embodiment, the processor 20 can determine that the quantity of refrigerant recovered by the system during a lifetime of an RRS (e.g., the RRS 11, 19, or 60) is equal to zero (e.g., 0.0 kg). The processor 20 can be programmed to determine there is no oil in the used oil storage container if the lifetime recovery counter indicates no refrigerant has been recovered by the RRS 60. In other words, if the processor 20 determines that the RRS 60 has not recovered any refrigerant, the processor 20 assumes that the used oil storage container is empty.

Next, block 906 includes determining, by the processor 20, a second weight measurement, wherein determining the second weight measurement comprises determining a weight of content in a used oil storage container (e.g., the used oil container 75 or 125) measured by a second scale (e.g., the scale 25 or 73) is outside a range between a third weight threshold and a fourth weight threshold.

The examples of the third and fourth weight thresholds in this paragraph pertain to block 906. As an example, the third weight threshold is about −30.0 g. As an example, about −30.0 g can be a value between −30.0 g±2.0 g (i.e., a value between −28.0 g to −32.0 g, inclusive). As another example, about −30.0 g can be a value between −30.0 g±10 percent (i.e., a value between −27.0 g to −33.0 g, inclusive). As yet another example, the third weight threshold can be −1.0 ounce. Other examples of the third weight threshold are also possible. As an example, the fourth weight threshold is about 30 g. As an example, about 30.0 g can be a value between 30.0 g±2.0 g (i.e., a value between 28.0 g to 32.0 g, inclusive). As another example, about 30.0 g can be a value between 30.0 g±10 percent (i.e., a value between 27.0 g to 33.0 g, inclusive). As yet another example, the fourth weight threshold can be 1.0 ounce. Other examples of the fourth weight threshold are also possible.

The examples of the third and fourth weight thresholds in this paragraph pertain to block 906. As an example, the third weight threshold is less than 0.0 kg and greater than −0.5 kg, and the fourth weight threshold is greater than 0.0 kg and less than 0.5. kg. As yet another example, the third weight threshold is less than zero and greater than a number equal to negative fifty percent of a capacity of the second scale, and the fourth weight threshold is greater than zero and less than a number equal to positive fifty percent of the capacity of the second scale.

Next, block 907 includes in response to making the second weight measurement, adjusting, by the processor 20, the second scale to read zero. As an example, the processor 20 can adjust the second scale by changing the scale reading 52 for the second scale to read a value representative of zero. As another example, the processor 20 can adjust the second scale by associating a signal level currently provided by the second scale with a weight value of zero.

Additional functions that can be performed in combination with the set 940 comprise determining, by the processor 20, a new oil storage container (e.g., the new oil storage container 74 or 136) is empty, and in response to determining the new oil storage container is empty, adjusting, by the processor 20, a third scale (e.g., the scale 24 or 72) to read zero. As an example, the processor 20 can adjust the third scale by changing the scale reading 52 for the third scale to read a value representative of zero. As another example, the processor 20 can adjust the third scale by associating a signal level currently provided by the second scale with a weight value of zero.

Yet another function that can be performed along the set 940 comprises receiving, by the processor 20, an input indicative of the new oil storage container being empty. Receiving the input can comprise the processor 20 receiving an input entered via a user interface (e.g. the user interface 22 or 78) of the RRS.

Even further additional functions that can be performed in combination with the set 940 comprise determining, by the processor 20, a new oil storage container (e.g., the new oil storage container 74 or 136) is not empty, and in response to determining the new oil storage container is not empty, performing, by the processor 20, a following step of the first operating state. As an example, the following step can comprise opening at least one valve coupled to the refrigerant storage tank or within a supply line coupled to both the refrigerant storage tank and a supply refrigerant storage tank. As another example, the following step can comprise adding during the fill refrigerant storage tank operating state, refrigerant into the RST 64 or 131 from the supply refrigerant storage tank 13.

Figure 11:
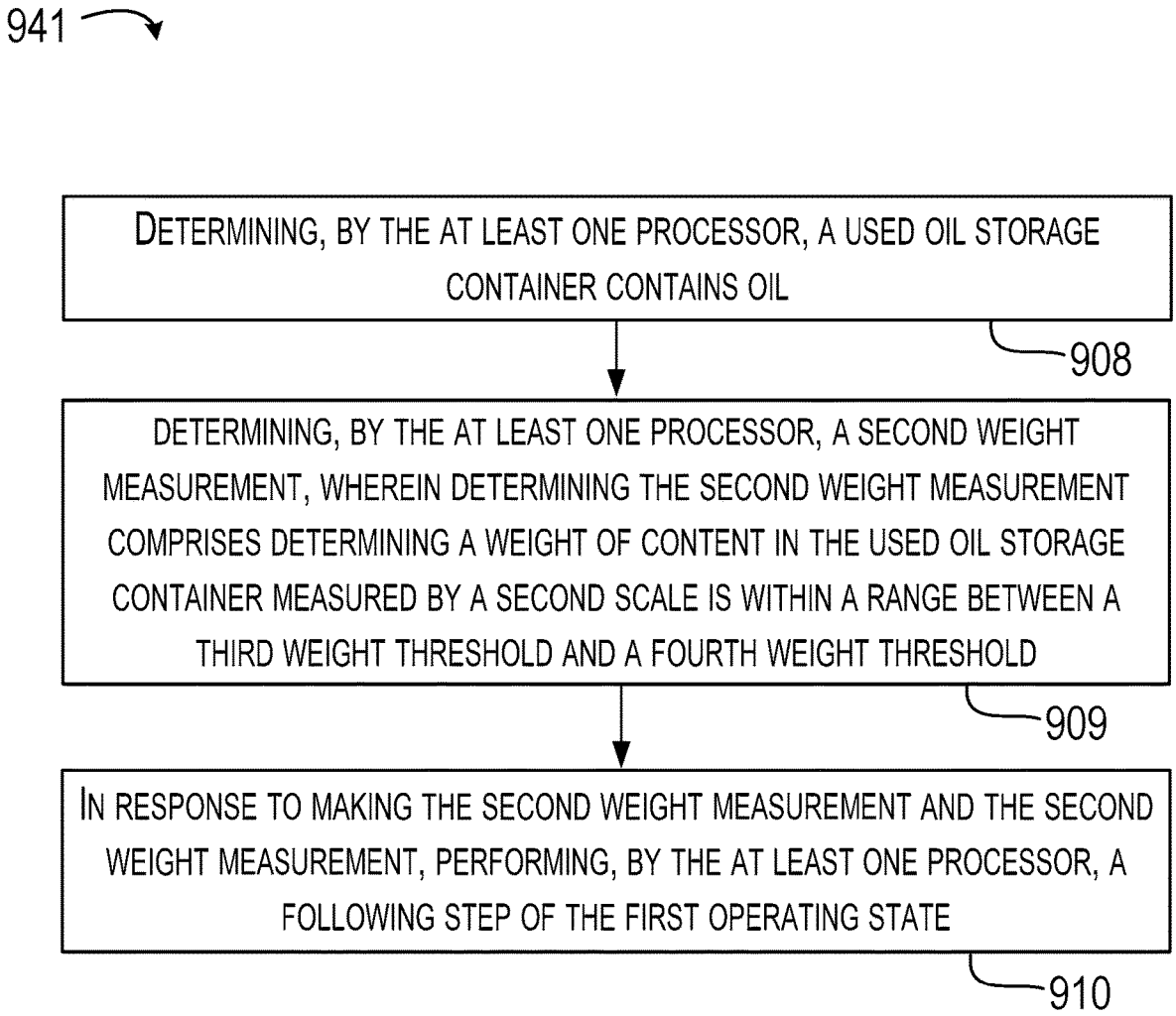

Turning to FIG. 11, the set of functions 941 comprises the functions of blocks 908, 909, and 910. As an example, the RRS 11, 19, or 60 can perform the set of functions 941 in combination with the set of functions 900 when the first operating state of block 901 is the fill refrigerant storage tank operating state.

Block 908 includes determining, by the processor 20, the used oil storage container (e.g., the used oil storage container 75 or 125) contains oil. In other words, the processor 20 can determine the used oil storage container is not empty. As an example, the processor 20 can receive input data from the user interface 78 indicative that there is oil in the used oil storage container. As another example, the processor 20 can refer to data stored in the counters 51 to determine whether or not there is any oil in the used oil storage container. The data used by the processor 20 determine the used oil storage container is not empty can indicate a quantity of refrigerant recovered by the RRS (e.g., the RRS 11, 19, or 60) during a lifetime of the RRS is greater than an amount of refrigerant indicative of any refrigerant having been added to the refrigerant storage tank (e.g., the RST 64 or 131). The processor 20 can determine the quantity by reading the lifetime recovery counter stored in the counters 51. Examples of the amount of refrigerant indicative of any refrigerant having been added to the refrigerant storage tank are described with respect to block 905. In an alternative embodiment, the processor 20 can determine that the quantity of refrigerant recovered by the system during a lifetime of an RRS (e.g., the RRS 11, 19, or 60) is equal to zero (e.g., 0.0 kg). The processor 20 can be programmed to determine there is oil in the used oil storage container if the lifetime recovery counter indicates at least some refrigerant has been recovered. In other words, if the processor 20 determines that the RRS 60 has recovered any refrigerant, the processor 20 assumes that the used oil storage container is not empty.

Next, block 909 includes determining, by the processor 20, a second weight measurement, wherein determining the second weight measurement comprises determining a weight of content in a used oil storage container (e.g., the used oil storage container 75 or 125) measured by a second scale (e.g., 73 or 25) is within a range between a third weight threshold and a fourth weight threshold. Examples of the third weight threshold for block 909 are similar to the examples of the third weight threshold described with respect to block 906. Examples of the fourth weight threshold for block 909 are similar to the examples of the fourth weight threshold described with respect to block 906.

Next, block 910 includes in response to making the second weight measurement, performing, by the processor 20, a following step of the first operating state. As an example, the following step can comprise opening at least one valve coupled to the refrigerant storage tank or within a supply line coupled to both the refrigerant storage tank and a supply refrigerant storage tank. As another example, the following step can comprise adding during the fill refrigerant storage tank operating state, refrigerant into the RST 64 or 131 from the supply refrigerant storage tank 13.

Figure 12:
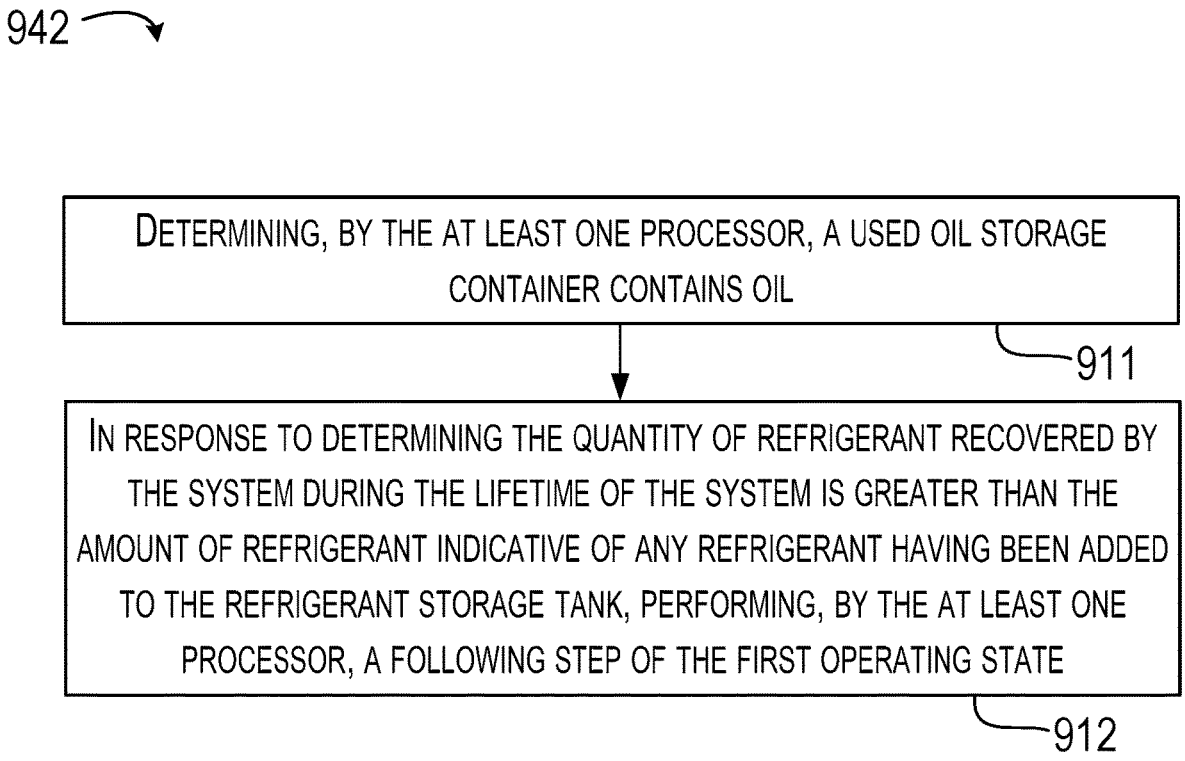

Turning to FIG. 12, the set of functions 942 comprises the functions of blocks 911 and 912. As an example, the RRS 11, 19, or 60 can perform the set of functions 942 in combination with the set of functions 900 when the first operating state of block 901 is the fill refrigerant storage tank operating state.

Block 911 includes determining, by the processor 20, the used oil storage container (e.g., the used oil storage container 75 or 125) contains oil. In other words, the processor 20 can determine the used oil storage container is not empty. As an example, the processor 20 can receive input data from the user interface 78 indicative that there is oil in the used oil storage container. As another example, the processor 20 can refer to data stored in the counters 51 to determine whether or not there is any oil in the used oil storage container. The data used by the processor 20 determine the used oil storage container is not empty can indicate a quantity of refrigerant recovered by the RRS (e.g., the RRS 11, 19, or 60) during a lifetime of the RRS is greater than an amount of refrigerant indicative of any refrigerant having been added to the refrigerant storage tank (e.g., the RST 64 or 131). The processor 20 can determine the quantity by reading the lifetime recovery counter in the counters 51. Examples of the amount of refrigerant indicative of any refrigerant having been added to the refrigerant storage tank are described with respect to block 905. In an alternative embodiment, the processor 20 can determine that the quantity of refrigerant recovered by the system during a lifetime of an RRS (e.g., the RRS 11, 19, or 60) is greater than zero (e.g., 0.0 kg). The processor 20 can be programmed to determine there is oil in the used oil storage container if the lifetime recovery counter indicates at least some refrigerant has been recovered. In other words, if the processor 20 determines that the RRS 60 has recovered any refrigerant, the processor 20 assumes that the used oil storage container is not empty.

Next, block 912 includes in response to determining the quantity of refrigerant recovered by the RRS during the lifetime of the RRS is greater than the amount of refrigerant indicative of any refrigerant having been added to the refrigerant storage tank, performing, by the processor 20, a following step of the first operating state. As an example, the following step can comprise opening at least one valve coupled to the refrigerant storage tank or within a supply line coupled to both the refrigerant storage tank and a supply refrigerant storage tank. As another example, the following step can comprise adding during the fill refrigerant storage tank operating state, refrigerant into the RST 64 or 131 from the supply refrigerant storage tank 13.

Figure 13:
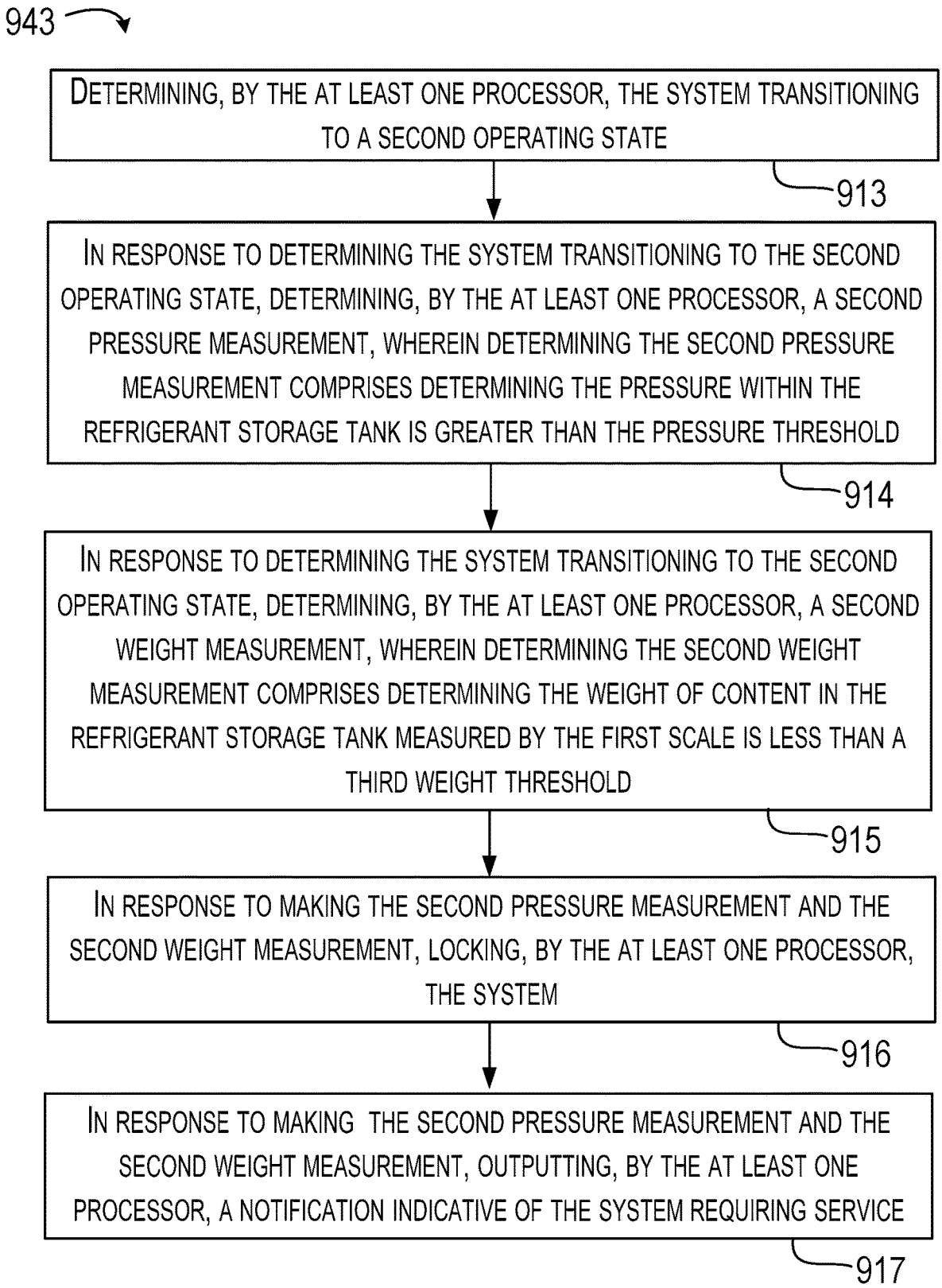

Turning to FIG. 13, the set of functions 943 comprises the functions of blocks 913, 914, 915, 916, and 917. As an example, the RRS 11, 19, or 60 can perform the set of functions 943 in combination with the set of functions 900 when the first operating state of block 901 is the power on operating state, the software reset operating state, the fill refrigerant storage tank operating state, the recover refrigerant operating state, the recycle refrigerant operating state, or the recharge refrigerant operating state.

Block 913 includes determining, by the processor 20, the RRS (e.g., the RRS 11, 19, or 60) transitioning to a second operating state. As an example, the second operating state can comprise the power on operating state, the software reset operating state, the fill refrigerant storage tank operating state, the recover refrigerant operating state, the recycle refrigerant operating state, or the recharge refrigerant operating state.

Next, block 914 includes in response to determining the RRS (e.g., 11, 19, or 60) transitioning to the second operating state, determining, by the processor 20, a second pressure measurement, wherein determining the second pressure measurement comprises determining the pressure within the refrigerant storage tank is greater than the pressure threshold. The processor 20 can determine the second pressure measurement from a signal provided by the PSD 137, for example. Examples of the pressure threshold are described with respect to block 902.

Next, block 915 includes in response to determining the RRS (e.g., 11, 19, or 60) transitioning to the second operating state, determining, by the processor 20, a second weight measurement, wherein determining the second weight measurement comprises determining the weight of content in the refrigerant storage tank (e.g., the RST 64 or 131) measured by the first scale (e.g., the scale 23 or 71) is less than a third weight threshold. As an example, the third weight threshold is about 0.5 kg. As an example, about 0.5 kg can be a value between 0.5 kg±0.2 kg (i.e., a value between 0.3 kg to 0.7 kg, inclusive). As another example, about 0.5 kg can be a value between 0.5 kg±10 percent (i.e., a value between 0.45 kg to 0.55 kg, inclusive). As yet another example, the third weight threshold is less than 0.0 kg. As still yet another example, the third weight threshold can be −0.5 pounds, −1.0 pounds or a value between −0.5 pounds and −1.0 pounds. Other examples of the third weight threshold are also possible.

Next, block 916 includes in response to making the second pressure measurement and the second weight measurement, locking, by the processor 20, the RRS (e.g., the RRS 11, 19, or 60). As an example, locking the RRS can comprise the processor 20 preventing the RRS from: recovering refrigerant from a cooling system, recycling refrigerant, recharging a cooling system with refrigerant, or filling the RST 64 or 131. As another example, locking the RRS can comprise the processor 20 preventing the RRS from transitioning from one operating state (e.g., the power on operating state) to another operating state (e.g., the a fill refrigerant storage tank operating state, the recover refrigerant operating state, the recycle refrigerant operating state, or the recharge refrigerant operating state). Other examples of locking the RRS are also possible.

Next, block 917 includes in response to making the second pressure measurement and the second weight measurement, outputting, by the processor 20, a notification indicative of the system requiring service. The notification can comprise the notification 151, for example. The display 81 can display the notification.

The RRS 11, 19, or 60 can be serviced in order to unlock the RRS. Unlocking the RRS can include removing or repairing a condition that caused the processor 20 to lock the RRS and repeating or performing a set of functions to ensure the scale(s) within the RRS are adjusted properly.

Figure 14:
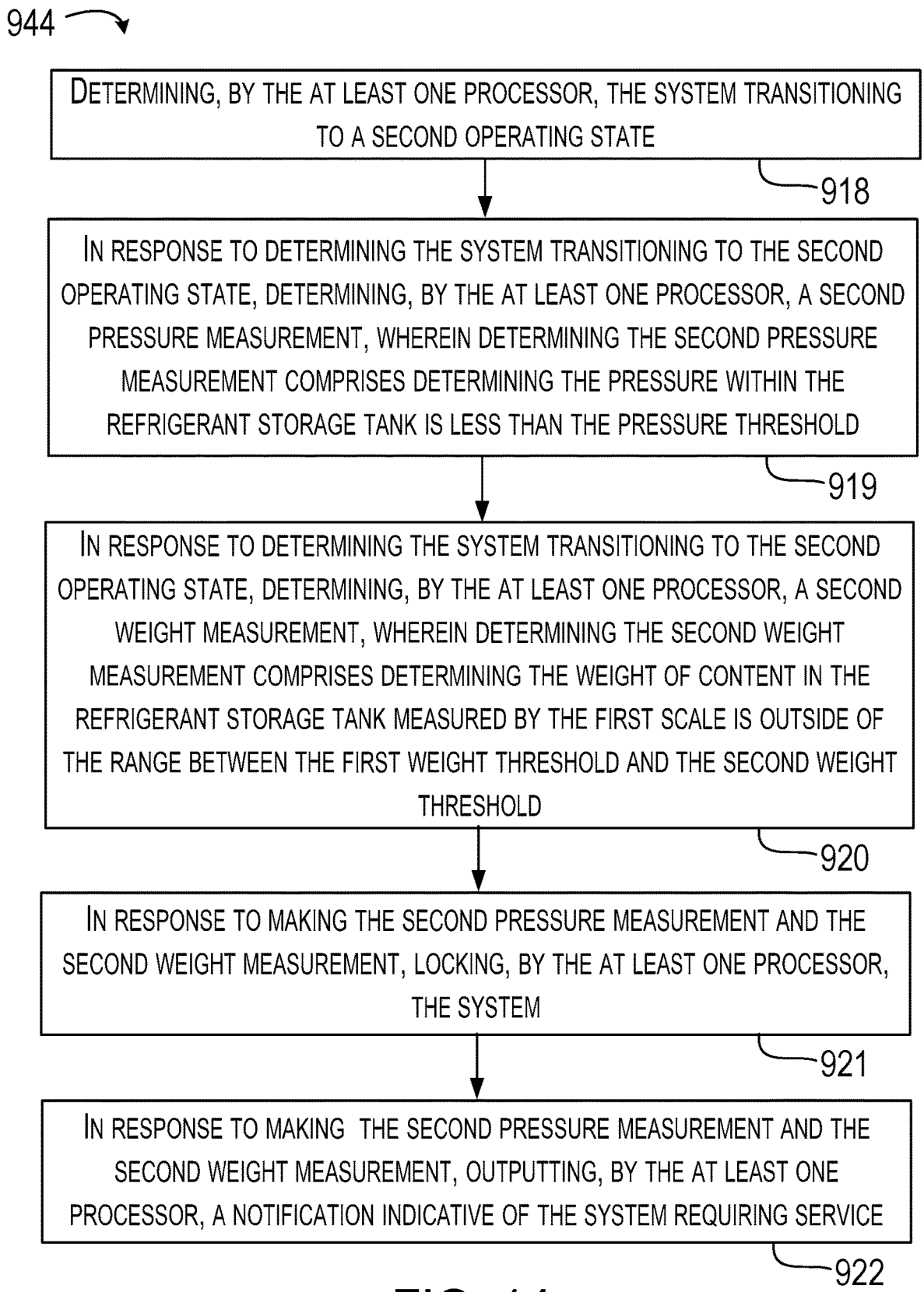

Turning to FIG. 14, the set of functions 944 comprises the functions of blocks 918, 919, 920, 921, and 922. As an example, the RRS 11, 19, or 60 can perform the set of functions 944 in combination with the set of functions 900 when the first operating state of block 901 is the power on operating state, the software reset operating state, the fill refrigerant storage tank operating state, the recover refrigerant operating state, the recycle refrigerant operating state, or the recharge refrigerant operating state.

Block 918 includes determining, by the processor 20, the RRS (e.g., the RRS 11, 19, or 60) transitioning to a second operating state. As an example, the second operating state can comprise the power on operating state, the software reset operating state, the fill refrigerant storage tank operating state, the recover refrigerant operating state, the recycle refrigerant operating state, or the recharge refrigerant operating state.

Next, block 919 includes in response to determining the RRS (e.g., 11, 19, or 60) transitioning to the second operating state, determining, by the processor 20, a second pressure measurement, wherein determining the second pressure measurement comprises determining the pressure within the refrigerant storage tank is less than the pressure threshold. The processor 20 can determine the second pressure measurement from a signal provided by the PSD 137, for example. Examples of the pressure threshold are described with respect to block 902.

Next, block 920 includes in response to determining the RRS (e.g., 11, 19, or 60) transitioning to the second operating state, determining, by the processor 20, a second weight measurement, wherein determining the second weight measurement comprises determining the weight of content in the refrigerant storage tank (e.g., the RST 64 or 131) measured by the first scale (e.g., the scale 23 or 71) is outside of the range between the first weight threshold and the second weight threshold. Examples of the first weight threshold and the second weight threshold are described above with respect to block 903.

Next, block 921 includes in response to making the second pressure measurement and the second weight measurement, locking, by the processor 20, the RRS (e.g., the RRS 11, 19, or 60). Examples of locking the RRS are described above with respect to block 916.

Next, block 922 includes in response to making the second pressure measurement and the second weight measurement, outputting, by the processor 20, a notification indicative of the system requiring service. The notification can comprise the notification 151, for example. The display 81 can display the notification.

Figure 15:
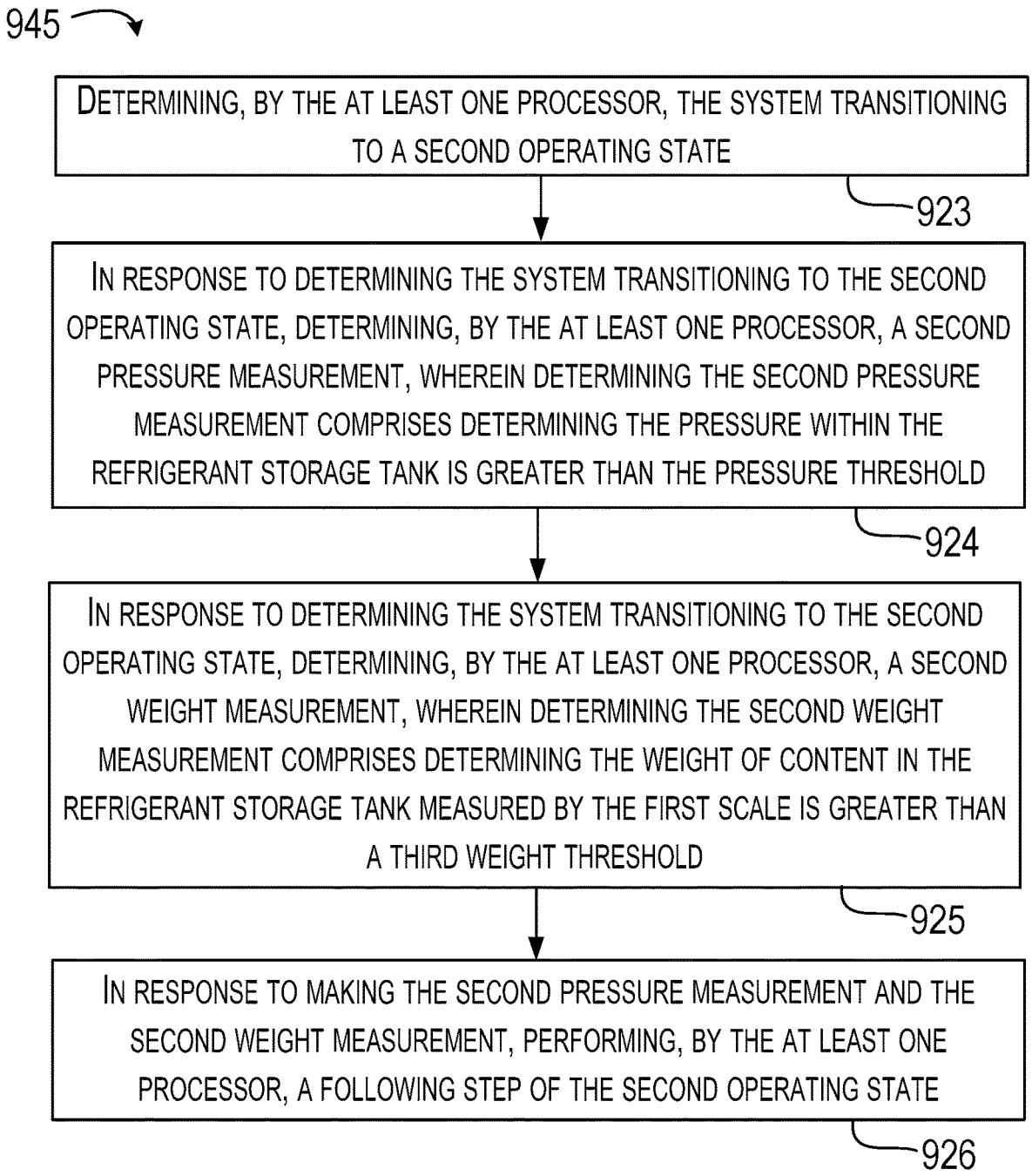

Turning to FIG. 15, the set of functions 945 comprises the functions of blocks 923, 924, 925, and 926. As an example, the RRS 11, 19, or 60 can perform the set of functions 945 in combination with the set of functions 900 when the first operating state of block 901 is the power on operating state, the software reset operating state, the fill refrigerant storage tank operating state, the recover refrigerant operating state, the recycle refrigerant operating state, or the recharge refrigerant operating state.

Block 923 includes determining, by the processor 20, the RRS (e.g., the RRS 11, 19, or 60) transitioning to a second operating state. As an example, the second operating state can comprise the power on operating state, the software reset operating state, the fill refrigerant storage tank operating state, the recover refrigerant operating state, the recycle refrigerant operating state, or the recharge refrigerant operating state.

Next, block 924 includes in response to determining the RRS (e.g., 11, 19, or 60) transitioning to the second operating state, determining, by the processor 20, a second pressure measurement, wherein determining the second pressure measurement comprises determining the pressure within the refrigerant storage tank is greater than the pressure threshold. Examples of the pressure threshold are described with respect to block 902.

Next, block 925 includes in response to determining the RRS (e.g., 11, 19, or 60) transitioning to the second operating state, determining, by the processor 20, a second weight measurement, wherein determining the second weight measurement comprises determining the weight of content in the refrigerant storage tank measured by the first scale (e.g., the scale 23 or 71) is greater than a third weight threshold. Examples of the third weight threshold are described with respect to block 915.

Next, block 926 includes in response to making the second pressure measurement and the second weight measurement, performing, by the processor 20, a following step of the second operating state. As an example the second operating state can comprise the fill refrigerant storage tank operating state. In accordance with that example, the following step can comprise opening at least one valve coupled to the refrigerant storage tank or within a supply line coupled to both the refrigerant storage tank and a supply refrigerant storage tank, or the following step can comprise adding during the fill refrigerant storage tank operating state, refrigerant into the RST 64 or 131 from the supply refrigerant storage tank 13.

Figure 16:
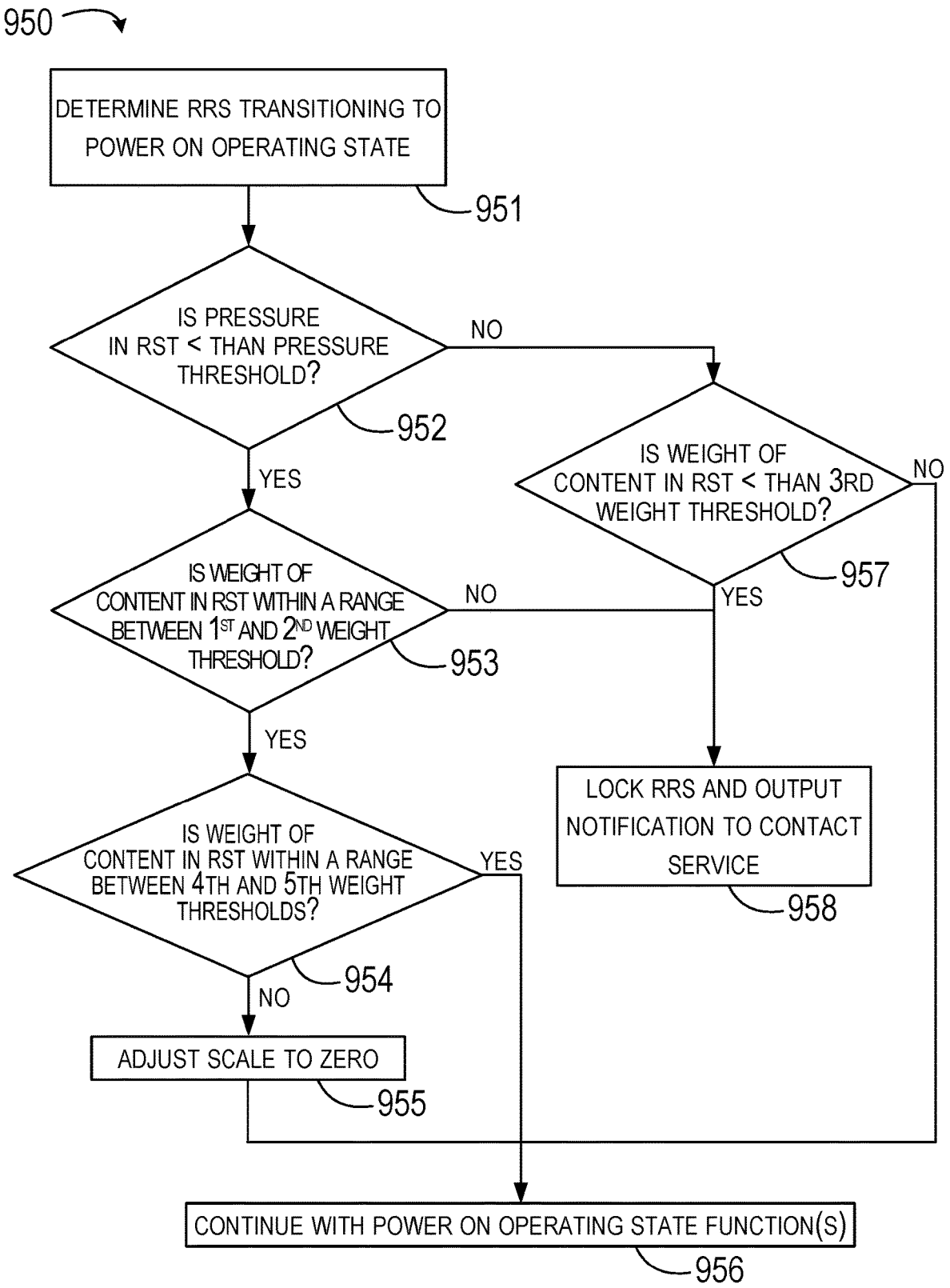
FIG. 16 is a flow chart showing multiple methods, according to example embodiments with respect to a power on operating state of a refrigerant recovery system.

Next. FIG. 16 shows a flowchart depicting a set of functions 950 (or more simply "the set 950") that can be carried out in accordance with the example embodiments described in this description. Functions of the set 950 can be performed by the RRS 11, 19, or 60. In particular, functions of the set 950 can be performed by a processor, such as the processor 20, of the RRS. The set 950 includes the functions shown in blocks labeled with whole numbers 951 through 958 inclusive. The following description of the set 950 includes references to elements shown in other figures described in this description, but the functions of the set 950 are not limited to being carried out only by the referenced elements.

Block 951 comprises the processor 20 determining the RRS is transitioning to the power on operating state. This transition can be initiated by plugging a power cord of the RRS into a power outlet or pressing the power switch 82 while the RRS is powered off. The function of block 901 is an example of the function of block 951.

Block 952 comprises the processor 20 determining whether or not a pressure in an RST (e.g., the RST 64 or 131) is less than a pressure threshold (e.g., the pressure threshold 47). Examples of the pressure threshold 47 are described above with respect to block 902. The function of block 902 is an example of the function of block 952.

Block 953 comprises the processor 20 determining if the weight of content in an RST (e.g., the RST 64 or 131) is within a range between a first weight threshold and a second weight threshold. Examples of the first and second weight thresholds are described above with respect to block 903. The functions of block 903, 913, and 919 are examples of the function of block 953.

Block 954 comprises the processor 20 determining whether or not the weight of content in an RST (e.g., the RST 64 or 131) is within a range between a fourth weight threshold and a fifth weight threshold. As an example, the fourth weight threshold is about −5.0 kg. As an example, about −5.0 kg can be a value between −5.0 kg±1.0 kg (i.e., a value between −4.0 kg to −6.0 kg, inclusive). As another example, about −5.0 kg can be a value between −5.0 kg±10 percent (i.e., a value between −4.5 kg to −5.5 kg, inclusive). As yet another example, the fourth weight threshold can be −0.2 pounds. Other examples of the fourth weight threshold are also possible. As an example, the fifth weight threshold is about 5.0 kg. As an example, about 5.0 kg can be a value between 5.0 kg±1.0 kg (i.e., a value between 4.0 kg to 6.0 kg, inclusive). As another example, about 5.0 kg can be a value between 5.0 kg±10 percent (i.e., a value between 4.5 kg to 5.5 kg, inclusive). As yet another example, the fifth weight threshold can be 0.2 pounds. Other examples of the fifth weight threshold are also possible. The function of block 954 can be performed when performing the set 900, such as before the function of block 904 is performed.

Block 955 comprises the processor 20 adjusting the scale to zero. This scale comprises the scale for weighing content of an RST, such as the scale 23 or 71. The function of block 904 is an example of the function of block 955.

Block 956 comprises continuing with the power on operating state function(s). As an example, the processor 20 can output a notification indicating a status of the RRS transitioning to the power on operating state. Other examples of a power on operating state function are possible.

Block 957 comprises the processor 20 determining whether or not the weight of content in the RST 64 or 131 is less than a third weight threshold. Examples of the third weight threshold are described above with respect to block 915. The functions of block 915 and 920 are examples of the function of block 957.

Block 958 comprises the processor 20 locking the RRS and outputting a notification to contact service, such as the notification 152. Examples of the processor 20 locking the RRS are described above. The functions of block 916 and 921 are examples of the function of block 958.

FIG. 16 illustrates multiple methods based on the set 950 that can be performed by the RRS 11, 19, or 60 with respect to the RRS powering on. A first method based on the set 950 includes the functions of blocks 951, 952, 953, 954, 955, and 956. A second method based on the set 950 includes the functions of blocks 951, 952, 957, and 956. A third method based on the set 950 includes the functions of blocks 951, 952, 957, and 958. A fourth method based on the set 950 includes the functions of blocks 951, 952, 953, and 958. A fifth method based on the set 950 includes the functions of blocks 951, 952, 953, 954, and 956.

Figure 17:
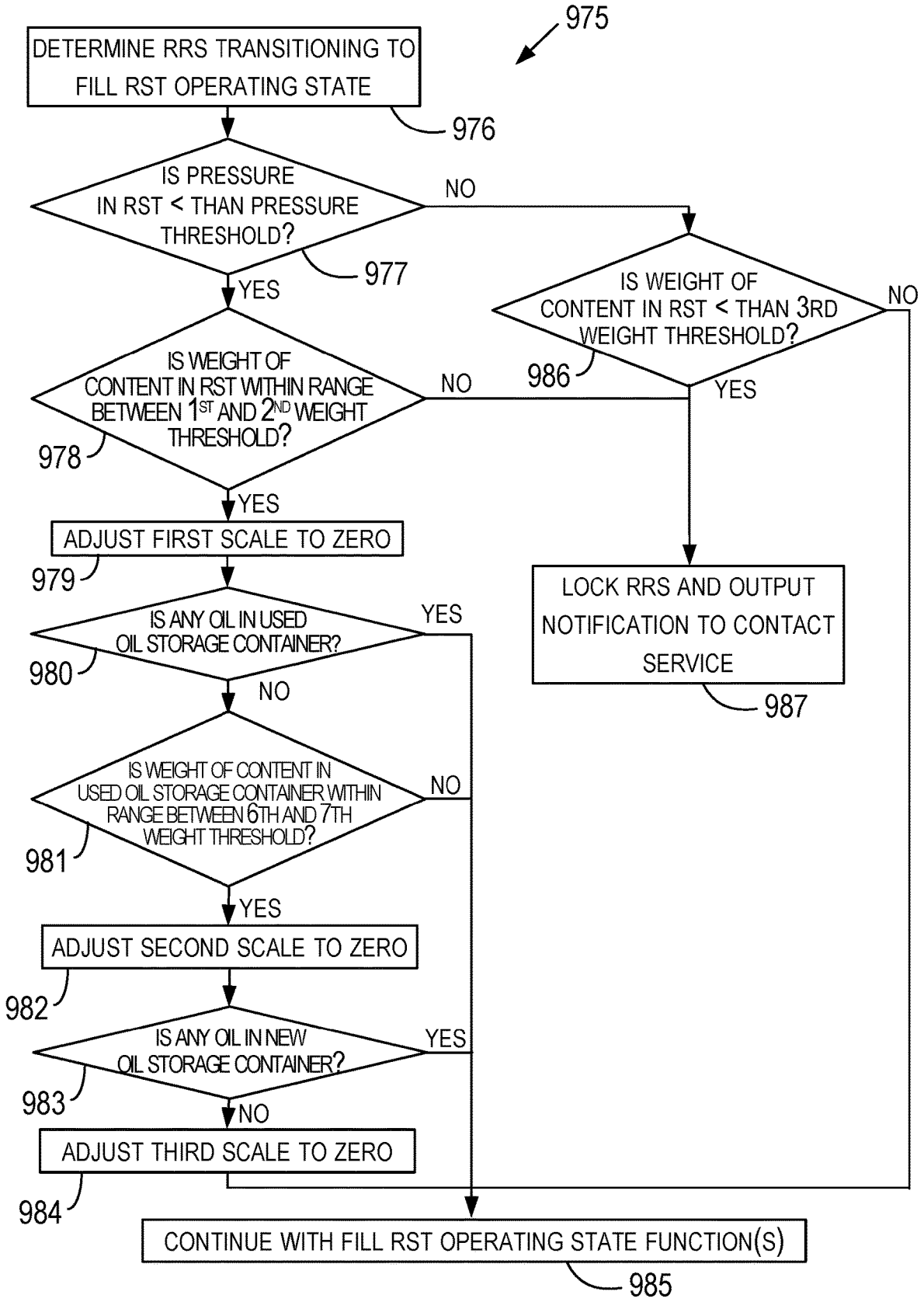
FIG. 17 is a flow chart showing multiple methods, according to example embodiments with respect to a fill refrigerant storage tank operating state of a refrigerant recovery system.

Next. FIG. 17 is a flowchart depicting a set of functions 975 (or more simply "the set 975") that can be carried out in accordance with the example embodiments described in this description. Functions of the set 975 can be performed by the RRS 11, 19, or 60. In particular, functions of the set 975 can be performed by a processor, such as the processor 20, of the RRS. The set 975 includes the functions shown in blocks labeled with whole numbers 976 through 987 inclusive. The following description of the set 975 includes references to elements shown in other figures described in this description, but the functions of the set 975 are not limited to being carried out only by the referenced elements.

Block 976 comprises the processor 20 determining the RRS is transitioning to the fill RST operating state. This transition can be initiated by pressing the fill RST selector switch 83, for example. The function of block 901 is an example of the function of block 976.

Block 977 comprises the processor 20 determining whether or not a pressure in an RST (e.g., the RST 64 or 131) is less than a pressure threshold (e.g., the pressure threshold 47). Examples of the pressure threshold 47 are described above. The functions of blocks 902, 914, 919, and 924 are examples of the function of block 977.

Block 978 comprises the processor 20 determining if the weight of content in an RST (e.g., the RST 64 or 131) is within a range between a first weight threshold and a second weight threshold. Examples of the first weight threshold and the second weight threshold are described above with respect to block 953. The functions of blocks 903 and 920 are examples of the function of block 978.

Block 979 comprises the processor 20 adjusting a first scale to zero. The first scale comprises the scale for weighing content of an RST, such as the scale 23 or 71. The function of block 904 is an example of the function of block 979.

Block 980 comprises the processor 20 determining whether or not there is any oil in the used oil storage container (e.g., the used oil storage container 74 or 125). In one respect, the processor 20 can determine the used oil storage container is empty or not empty based on data the processor 20 receives from the user interface 78 indicative of whether or not there is oil in the used oil storage container. In another respect, the processor 20 can make the determination for block 980 by referring to data stored in the counters 51 and comparing the data to an eighth weight threshold. For example, the counters 51 can comprise the lifetime recovery counter is less than the eighth weight threshold. As an example, the eighth weight threshold is about 1.0 kg. As an example, about 1.0 kg can be a value between 1.0 kg±0.2 kg (i.e., a value between 0.8 kg to 1.2 kg, inclusive). As another example, about 1.0 kg can be a value between 1.0 kg±10 percent (i.e., a value between 0.9 kg to 1.1 kg, inclusive). Other examples of the eighth weight threshold are also possible. As another example, the eighth weight threshold is 2.0 pounds. The functions of blocks 905, 908, and 911 are examples of the function of block 980.

Block 981 comprises the processor 20 determining if the weight of content in a used oil storage container (e.g., the used oil storage container 74 or 125) is within a range between a sixth weight threshold and a seventh weight threshold. As an example, the sixth weight threshold is about −30.0 grams. As an example, about −30.0 grams can be a value between −30.0 grams±2.0 grams (i.e., a value between −28.0 grams to −32.0 grams, inclusive). As another example, about −30 grams can be a value between −30 grams±10 percent (i.e., a value between −27.0 grams to −33.0 grams, inclusive). As another example, the sixth weight threshold is −1.0 ounce. Other examples of the sixth weight threshold are also possible. As an example, the seventh weight threshold is about 30.0 grams. As an example, about 30.0 grams can be a value between 30.0 grams±2.0 grams (i.e., a value between 28.0 grams to 32.0 grams, inclusive). As another example, about 30 grams can be a value between 30 grams±10 percent (i.e., a value between 27.0 grams to 33.0 grams, inclusive). As another example, the seventh weight threshold is 1.0 ounce. Other examples of the seventh weight threshold are also possible. The functions of blocks 906 and 909 are examples of the function of block 981 except that the sixth and seventh weight thresholds are referred to as third and fourth weight thresholds, respectively.

Block 982 comprises the processor 20 adjusting a second scale to zero. The second scale can comprise the scale for weighing content of a used oil storage container, such as the scale 25 or 73. The function of block 907 is an example of the function of block 982.

Block 983 comprises the processor 20 determining whether or not any oil is in the new oil storage container (e.g., the new oil storage container 74 or 136). As an example, the processor 20 can make this determination by outputting a notification, such as the notification 167, to prompt a user to visually inspect the new oil storage container and select a selectable segment associated with a result of the visual inspection, and receiving a signal indicative of the selectable segment being selected. As another example, the RRS 11, 19, of 60 can be equipped with a sensor, other than the scale to weigh content of the new oil storage container, adapted to provide the processor 20 with a signal indicative of whether or not any oil is in the new oil storage container. That sensor could be a flow sensor, for example.

Block 984 comprises the processor 20 adjusting a third scale to zero. The third scale can comprise the scale for weighing content of a new oil storage container, such as the scale 24 or 72.

Block 985 comprises continuing with the fill RST operating state function(s). As an example, the processor 20 can output a notification indicating a status of the RRS transitioning to the fill RST operating state. An another example, the processor 20 can control a valve within the RRS to allow refrigerant from the supply RST 13 to flow into the RST 64 or 131. Other examples of a fill RST operating state function are possible. The function of block 926 is an example of the function of block 985.

Block 986 comprises the processor 20 determining whether or not the weight of content in the RST (e.g., the RST 64 or 131) is less than a third weight threshold.

Examples of the third weight threshold are described above with respect to block 957. The functions of blocks 915 and 925 are examples of the function of block 986.

Block 987 comprises the processor 20 locking the RRS and outputting a notification to contact service, such as the notification 152. Examples of the processor 20 locking the RRS are described above. The functions of blocks 916 and 921 are examples of the function of block 987.

FIG. 17 illustrates multiple methods based on the set 975 that can be performed by the RRS 11, 19, or 60 with respect to the fill RST operating state. A first method based on the set 975 includes the functions of blocks 976, 977, 978, 979, 980, 981, 982, 983, 984, and 985. A second method based on the set 975 includes the functions of blocks 976, 977, 986, and 985. A third method based on the set 975 includes the functions of blocks 976, 977, 986, and 987. A fourth method based on the set 975 includes the functions of blocks 976, 977, 978, and 987. A fifth method based on the set 975 includes the functions of blocks 976, 977, 978, 979, 980, and 985. A sixth method based on the set 975 includes the functions of blocks 976, 977, 978, 979, 980, 981, and 985. A seventh method based on the set 975 includes the functions of blocks 976, 977, 978, 979, 980, 981, 982, 983, and 985.

V. Conclusion

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the claims, along with the full scope of equivalents to which such claims are entitled. It is also to be understood that the terminology used herein is for the purpose of describing particular embodiments only, and is not intended to be limiting.

Embodiments of the present disclosure may thus relate to one of the enumerated example embodiments (EEEs) listed below.

EEE 1 is a method performed by a system, for recovering refrigerant, comprising a refrigerant storage tank and a first scale, the method comprising: determining, by at least one processor, the system transitioning to a first operating state; in response to determining the system transitioning to the first operating state, determining, by the at least one processor, a first pressure measurement, wherein determining the first pressure measurement comprises determining a pressure within the refrigerant storage tank is less than a pressure threshold; in response to determining the system transitioning to the first operating state, determining, by the at least one processor, a first weight measurement, wherein determining the first weight measurement comprises determining a weight of content in the refrigerant storage tank measured by the first scale is within a range between a first weight threshold and a second weight threshold; and in response to making the first pressure measurement and the first weight measurement, adjusting, by the at least one processor, the first scale to read zero.

EEE 2 is the method of EEE 1, wherein the first operating state comprises a power on operating state, a software reset operating state, a fill refrigerant storage tank operating state, a recover refrigerant operating state, a recycle refrigerant operating state, or a recharge refrigerant operating state.

EEE 3 is the method of EEE 1 or 2, wherein the pressure threshold is between 0.0 bar and 2.1 bar.

EEE 4 is the method of any one of EEE 1 to 3, wherein the pressure threshold is below a vapor pressure in the refrigerant storage tank at an ambient operating temperature of the system.

EEE 5 is the method of any one of EEE 1 to 4, wherein the first weight threshold is less than about −13.0 kilograms, and wherein the second weight threshold is greater than about 13.0 kilograms.

EEE 6 is the method of any one of EEE 1 to 5, wherein the first operating state comprises a fill refrigerant storage tank operating state, the method further comprising: determining, by the at least one processor, a quantity of refrigerant recovered by the system during a lifetime of the system is less than an amount of refrigerant indicative of any refrigerant having been added to the refrigerant storage tank; determining, by the at least one processor, a second weight measurement, wherein determining the second weight measurement comprises determining a weight of content in a used oil storage container measured by a second scale is outside a range between a third weight threshold and a fourth weight threshold; and in response to making the second weight measurement, adjusting, by the at least one processor, the second scale to read zero.

EEE 7 is the method of EEE 6, wherein the third weight threshold is about −30.0 grams and the fourth weight threshold is about 30.0 grams EEE 8 is the method of EEE 6, wherein the third weight threshold is less than 0.0 kilograms and greater than −0.5 kilograms, and wherein the fourth weight threshold is greater than 0.0 kilograms and less than 0.5 kilograms.

EEE 9 is the method of EEE 6, wherein the third weight threshold is less than zero and greater than a number equal to negative fifty percent of a capacity of the second scale, and wherein the fourth weight threshold is greater than zero and less than a number equal to positive fifty percent of the capacity of the second scale.

EEE 10 is the method of any one of EEE 1 to 9, further comprising: determining, by the at least one processor, a new oil storage container is empty; and in response to determining the new oil storage container is empty, adjusting, by the at least one processor, a third scale to read zero.

EEE 11 is the method of EEE 10, further comprising: receiving, by the at least one processor, an input indicative of the new oil storage container being empty, wherein receiving the input comprises receiving, by the at least one processor, an input entered via a user interface of the system.

EEE 12 is the method of any one of EEE 1 to 9, further comprising: determining, by the at least one processor, a new oil storage container is not empty; and in response to determining the new oil storage container is not empty, performing, by the at least one processor, a following step of the first operating state.

EEE 13 is the method of EEE 12, wherein the following step of the first operating state comprises opening at least one valve coupled to the refrigerant storage tank or within a supply line coupled to both the refrigerant storage tank and a supply refrigerant storage tank; the method further comprising: adding, during the fill refrigerant storage tank operating state, refrigerant into the refrigerant storage tank from the supply refrigerant storage tank.

EEE 14 is the method of EEE 1, wherein the first operating state comprises a fill refrigerant storage tank operating state, the method further comprising: determining, by the at least one processor, a quantity of refrigerant recovered by the system during a lifetime of the system is less than an amount of refrigerant indicative of any refrigerant having been added to the refrigerant storage tank;

determining, by the at least one processor, a second weight measurement, wherein determining the second weight measurement comprises determining a weight of content in a used oil storage container measured by a second scale is within a range between a third weight threshold and a fourth weight threshold; and in response to making the second weight measurement, performing, by the at least one processor, a following step of the first operating state.

EEE 15 is the method of EEE 1, wherein the first operating state comprises a fill refrigerant storage tank operating state, the method further comprising: determining, by the at least one processor, a quantity of refrigerant recovered by the system during a lifetime of the system is greater than an amount of refrigerant indicative of any refrigerant having been added to the refrigerant storage tank; and in response to determining the quantity of refrigerant recovered by the system during the lifetime of the system is greater than the amount of refrigerant indicative of any refrigerant having been added to the refrigerant storage tank, performing, by the at least one processor, a following step of the first operating state.

EEE 16 is the method of any one of EEE 1 to 15, further comprising: determining, by the at least one processor, the system transitioning to a second operating state; in response to determining the system transitioning to the second operating state, determining, by the at least one processor, a second pressure measurement, wherein determining the second pressure measurement comprises determining the pressure within the refrigerant storage tank is greater than the pressure threshold; in response to determining the system transitioning to the second operating state, determining, by the at least one processor, a second weight measurement, wherein determining the second weight measurement comprises determining the weight of content in the refrigerant storage tank measured by the first scale is less than a third weight threshold; and in response to making the second pressure measurement and the second weight measurement, locking, by the at least one processor, the system.

EEE 17 is the method of EEE 16, wherein the third weight threshold is less than 0.0 kilograms EEE 18 is the method of EEE 16 or 17, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

EEE 19 is the method of any one of EEE 16 to 18, further comprising: in response to making the second pressure measurement and the second weight measurement, outputting, by the at least one processor, a notification indicative of the system requiring service.

EEE 20 is the method of any one of EEE 1 to 15, further comprising: determining, by the at least one processor, the system transitioning to a second operating state; in response to determining the system transitioning to the second operating state, determining, by the at least one processor, a second pressure measurement, wherein determining the second pressure measurement comprises determining the pressure within the refrigerant storage tank is less than the pressure threshold; in response to determining the system transitioning to the second operating state, determining, by the at least one processor, a second weight measurement, wherein determining the second weight measurement comprises determining the weight of content in the refrigerant storage tank measured by the first scale is outside of the range between the first weight threshold and the second weight threshold; and in response to making the second pressure measurement and the second weight measurement, locking, by the at least one processor, the system.

EEE 21 is the method of EEE 20, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

EEE 22 is the method of EEE 20 or 21, further comprising: in response to making the second pressure measurement and the second weight measurement, outputting, by the at least one processor, a notification indicative of the system requiring service.

EEE 23 is the method of any one of EEE 1 to 15, further comprising: determining, by the at least one processor, the system transitioning to a second operating state; in response to determining the system transitioning to the second operating state, determining, by the at least one processor, a second pressure measurement, wherein determining the second pressure measurement comprises determining the pressure within the refrigerant storage tank is greater than the pressure threshold; in response to determining the system transitioning to the second operating state, determining, by the at least one processor, a second weight measurement, wherein determining the second weight measurement comprises determining the weight of content in the refrigerant storage tank measured by the first scale is greater than a third weight threshold; and in response to making the second pressure measurement and the second weight measurement, performing, by the at least one processor, a following step of the second operating state.

EEE 24 is the method of EEE 23, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

EEE 25 is the method of EEE 23, wherein the second operating state comprises a fill refrigerant storage tank operating state, and wherein the following step of the second operating state comprises opening at least one valve coupled to the refrigerant storage tank or within a supply line coupled to both the refrigerant storage tank and a supply refrigerant storage tank; the method further comprising: adding, during the fill refrigerant storage tank operating state, refrigerant into the refrigerant storage tank from the supply refrigerant storage tank.

EEE 26 is a system for recovering refrigerant, the system comprising: a refrigerant storage tank, a first scale, and at least one processor, wherein the at least one processor is adapted for: determining the system is transitioning to a first operating state; in response to determining the system is transitioning to the first operating state, determining a first pressure measurement, wherein determining the first pressure measurement comprises determining a pressure within the refrigerant storage tank is less than a pressure threshold; in response to determining the system is transitioning to the first operating state, determining a first weight measurement, wherein determining the first weight measurement comprises determining a weight of content in the refrigerant storage tank measured by the first scale is within a range between a first weight threshold and a second weight threshold; and in response to making the first pressure measurement and the first weight measurement, adjusting the first scale to read zero.

EEE 27 is the system of EEE 26, wherein the first operating state comprises a power on operating state, a software reset operating state, a fill refrigerant storage tank operating state, a recover refrigerant operating state, a recycle refrigerant operating state, or a recharge refrigerant operating state.

EEE 28 is the system of EEE 26, wherein the pressure threshold is between 0.0 bar and 2.1 bar.

EEE 29 is the system of EEE 26, wherein the pressure threshold is below a vapor pressure in the refrigerant storage tank at an ambient operating temperature of the system.

EEE 30 is the system of EEE 26, wherein the first weight threshold is less than −13.0 kilograms, and wherein the second weight threshold is greater than 13.0 kilograms.

EEE 31 is the system of EEE 26, further comprising: a second scale; and an oil storage container, wherein the first operating state comprises a fill refrigerant storage tank operating state, wherein the at least one processor is further adapted for: determining a quantity of refrigerant recovered by the system during a lifetime of the system is less than an amount of refrigerant indicative of any refrigerant having been added to the refrigerant storage tank; determining a second weight measurement; and in response to making the second weight measurement, adjusting the second scale to read zero, wherein determining the second weight measurement comprises determining a weight of content in the used oil storage container measured by the second scale is outside a range between a third weight threshold and a fourth weight threshold.

EEE 32 is the system of EEE 31, wherein the third weight threshold is about −30.0 grams and the fourth weight threshold is about 30.0 grams.

EEE 33 is the system of EEE 31, wherein the third weight threshold is less than 0.0 kilograms and greater than −0.5 kilograms, and wherein the fourth weight threshold is greater than 0.0 kilograms and less than 0.5 kilograms.

EEE 34 is the system of EEE 31, wherein the third weight threshold is less than zero and greater than a number equal to negative fifty percent of a capacity of the second scale, and wherein the fourth weight threshold is greater than zero and less than a number equal to positive fifty percent of the capacity of the second scale.

EEE 35 is the system of EEE 31, further comprising: a new oil storage container; and a third scale, wherein the at least one processor is further adapted for: determining the new oil storage container is empty; and in response to determining the new oil storage container is empty, adjusting the third scale to read zero.

EEE 36 is the system of EEE 35, further comprising: a user interface; wherein the at least one processor is further adapted for: receiving an input indicative of the new oil storage container being empty, wherein receiving the input comprises receiving an input entered via the user interface.

EEE 37 is the system of EEE 31, further comprising: a new oil storage container, wherein the at least one processor is further adapted for: determining the new oil storage container is not empty; and in response to determining the new oil storage container is not empty, performing a following step of the first operating state.

EEE 38 is the system of EEE 37, further comprising: at least one valve coupled to the refrigerant storage tank or within a supply line coupled to both the refrigerant storage tank and a supply refrigerant storage tank, wherein the following step of the first operating state comprises opening the at least one valve and adding, during the fill refrigerant storage tank operating state, refrigerant into the refrigerant storage tank from the supply refrigerant storage tank.

EEE 39 is the system of EEE 26, wherein the first operating state comprises a fill refrigerant storage tank operating state, wherein the at least one processor is further adapted for: determining a quantity of refrigerant recovered by the system during a lifetime of the system is less than an amount of refrigerant indicative of any refrigerant having been added to the refrigerant storage tank; determining a second weight measurement, wherein determining the second weight measurement comprises determining a weight of content in a used oil storage container measured by a second scale is within a range between a third weight threshold and a fourth weight threshold; and in response to making the second weight measurement, performing a following step of the first operating state.

EEE 40 is the system of EEE 26, wherein the first operating state comprises a fill refrigerant storage tank operating state, wherein the at least one processor is further adapted for: determining a quantity of refrigerant recovered by the system during a lifetime of the system is greater than an amount of refrigerant indicative of any refrigerant having been added to the refrigerant storage tank; and in response to determining the quantity of refrigerant recovered by the system during the lifetime of the system is greater than the amount of refrigerant indicative of any refrigerant having been added to the refrigerant storage tank, performing a following step of the first operating state.

EEE 41 is the system of EEE 26, further comprising: wherein the at least one processor is further adapted for: determining the system is transitioning to a second operating state; in response to determining the system is transitioning to the second operating state, determining a second pressure measurement, wherein determining the second pressure measurement comprises determining the pressure within the refrigerant storage tank is greater than the pressure threshold; in response to determining the system is transitioning to the second operating state, determining a second weight measurement, wherein determining the second weight measurement comprises determining the weight of content in the refrigerant storage tank measured by the first scale is less than a third weight threshold; and in response to making the second pressure measurement and the second weight measurement, locking the system.

EEE 42 is the system of EEE 41, wherein the third weight threshold is less than 0.0 kilograms EEE 43 is the system of EEE 41, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

EEE 44 is the system of EEE 41, wherein the at least one processor is further adapted for: in response to making the second pressure measurement and the second weight measurement, outputting a notification indicative of the system requiring service.

EEE 45 is the system of EEE 26, wherein the at least one processor is further adapted for: determining the system is transitioning to a second operating state; in response to determining the system is transitioning to the second operating state, determining a second pressure measurement, wherein determining the second pressure measurement comprises determining the pressure within the refrigerant storage tank is less than the pressure threshold; in response to determining the system is transitioning to the second operating state, determining a second weight measurement, wherein determining the second weight measurement comprises determining the weight of content in the refrigerant storage tank measured by the first scale is outside of the range between the first weight threshold and the second weight threshold; and in response to making the second pressure measurement and the second weight measurement, locking the system.

EEE 46 is the system of EEE 45, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

EEE 47 is the system of EEE 45, further comprising: wherein the at least one processor is further adapted for: in response to making the second pressure measurement and the second weight measurement, outputting a notification indicative of the system requiring service.

EEE 48 is the system of EEE 26, wherein the at least one processor is further adapted for: determining the system is transitioning to a second operating state; in response to determining the system is transitioning to the second operating state, determining a second pressure measurement, wherein determining the second pressure measurement comprises determining the pressure within the refrigerant storage tank is greater than the pressure threshold; in response to determining the system is transitioning to the second operating state, determining a second weight measurement, wherein determining the second weight measurement comprises determining the weight of content in the refrigerant storage tank measured by the first scale is greater than a third weight threshold; and in response to making the second pressure measurement and the second weight measurement, performing a following step of the second operating state.

EEE 49 is the system of EEE 48, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

EEE 50 is the system of EEE 48, further comprising: at least one valve coupled to the refrigerant storage tank or within a supply line coupled to both the refrigerant storage tank and a supply refrigerant storage tank, wherein the second operating state comprises a fill refrigerant storage tank operating state, wherein the following step of the second operating state comprises opening the at least one valve, and wherein the at least one processor is further adapted for: adding, during the fill refrigerant storage tank operating state, refrigerant into the refrigerant storage tank from the supply refrigerant storage tank.

EEE 51 is a non-transitory computer-readable memory having stored therein instructions executable by at least one processor to cause a processor to perform functions comprising: determining a system, comprising a refrigerant storage tank and a first scale, transitioning to a first operating state; in response to determining the system transitioning to the first operating state, determining, by the at least one processor, a first pressure measurement, wherein determining the first pressure measurement comprises determining a pressure within the refrigerant storage tank is less than a pressure threshold; in response to determining the system transitioning to the first operating state, determining a first weight measurement, wherein determining the first weight measurement comprises determining a weight of content in the refrigerant storage tank measured by the first scale is within a range between a first weight threshold and a second weight threshold; and in response to making the first pressure measurement and the first weight measurement, adjusting the first scale to read zero.

EEE 52 is a system for recovering refrigerant, the system comprising: a refrigerant storage tank, a first scale, and at least one processor, wherein the at least one processor is adapted for performing a set of functions to be performed, the set of functions comprising a method in accordance with any one of EEEs 1 to 25.

EEE 53 is a computer-readable medium storing program instructions, that when executed by a computing device, cause a set of functions to be performed, the set of functions comprising a method in accordance with any one of EEEs 1 to 25.

We claim:

1. A method performed by a system, for recovering refrigerant, comprising a refrigerant storage tank and a first scale, the method comprising:

determining, by at least one processor, the system transitioning to a first operating state;

in response to determining the system transitioning to the first operating state, determining, by the at least one processor, a first pressure measurement, wherein determining the first pressure measurement comprises determining a pressure within the refrigerant storage tank is less than a pressure threshold;

in response to determining the system transitioning to the first operating state, determining, by the at least one processor, a first weight measurement, wherein determining the first weight measurement comprises determining a weight of content in the refrigerant storage tank measured by the first scale is within a range between a first weight threshold and a second weight threshold, wherein the first weight threshold is less than zero; and in response to making the first pressure measurement and the first weight measurement, adjusting, by the at least one processor, the first scale to read zero.

2. The method of claim 1, wherein the pressure threshold is below a vapor pressure in the refrigerant storage tank at an ambient operating temperature of the system.

3. The method of claim 1, wherein the first operating state comprises a fill refrigerant storage tank operating state, the method further comprising:

determining, by the at least one processor, a quantity of refrigerant recovered by the system during a lifetime of the system is less than an amount of refrigerant indicative of any refrigerant having been added to the refrigerant storage tank;

determining, by the at least one processor, a second weight measurement, wherein determining the second weight measurement comprises determining a weight of content in a used oil storage container measured by a second scale is outside a range between a third weight threshold and a fourth weight threshold; and in response to making the second weight measurement, adjusting, by the at least one processor, the second scale to read zero.

4. The method of claim 1, wherein the first operating state comprises a fill refrigerant storage tank operating state, the method further comprising:

determining, by the at least one processor, a quantity of refrigerant recovered by the system during a lifetime of the system is less than an amount of refrigerant indicative of any refrigerant having been added to the refrigerant storage tank;

determining, by the at least one processor, a second weight measurement, wherein determining the second weight measurement comprises determining a weight of content in a used oil storage container measured by a second scale is within a range between a third weight threshold and a fourth weight threshold; and in response to making the second weight measurement, performing, by the at least one processor, a following step of the first operating state.

5. The method of claim 1, wherein the first operating state comprises a fill refrigerant storage tank operating state, the method further comprising:

determining, by the at least one processor, a quantity of refrigerant recovered by the system during a lifetime of the system is greater than an amount of refrigerant indicative of any refrigerant having been added to the refrigerant storage tank; and in response to determining the quantity of refrigerant recovered by the system during the lifetime of the system is greater than the amount of refrigerant indicative of any refrigerant having been added to the refrigerant storage tank, performing, by the at least one processor, a following step of the first operating state.

6. The method of claim 1, further comprising:

determining, by the at least one processor, the system transitioning to a second operating state;

in response to determining the system transitioning to the second operating state, determining, by the at least one processor, a second pressure measurement, wherein determining the second pressure measurement comprises determining the pressure within the refrigerant storage tank is greater than the pressure threshold;

in response to determining the system transitioning to the second operating state, determining, by the at least one processor, a second weight measurement, wherein determining the second weight measurement comprises determining the weight of content in the refrigerant storage tank measured by the first scale is less than a third weight threshold; and in response to making the second pressure measurement and the second weight measurement, locking, by the at least one processor, the system.

7. The method of claim 1, further comprising:

determining, by the at least one processor, the system transitioning to a second operating state;

in response to determining the system transitioning to the second operating state, determining, by the at least one processor, a second pressure measurement, wherein determining the second pressure measurement comprises determining the pressure within the refrigerant storage tank is less than the pressure threshold;

in response to determining the system transitioning to the second operating state, determining, by the at least one processor, a second weight measurement, wherein determining the second weight measurement comprises determining the weight of content in the refrigerant storage tank measured by the first scale is outside of the range between the first weight threshold and the second weight threshold; and in response to making the second pressure measurement and the second weight measurement, locking, by the at least one processor, the system.

8. The method of claim 1, further comprising:

determining, by the at least one processor, the system transitioning to a second operating state;

in response to determining the system transitioning to the second operating state, determining, by the at least one processor, a second pressure measurement, wherein determining the second pressure measurement comprises determining the pressure within the refrigerant storage tank is greater than the pressure threshold;

in response to determining the system transitioning to the second operating state, determining, by the at least one processor, a second weight measurement, wherein determining the second weight measurement comprises determining the weight of content in the refrigerant storage tank measured by the first scale is greater than a third weight threshold; and in response to making the second pressure measurement and the second weight measurement, performing, by the at least one processor, a following step of the second operating state.

9. A system for recovering refrigerant, the system comprising:

a refrigerant storage tank, a first scale, and at least one processor, wherein the at least one processor is adapted for:

determining the system is transitioning to a first operating state;

in response to determining the system is transitioning to the first operating state, determining a first pressure measurement, wherein determining the first pressure measurement comprises determining a pressure within the refrigerant storage tank is less than a pressure threshold;

in response to determining the system is transitioning to the first operating state, determining a first weight measurement, wherein determining the first weight measurement comprises determining a weight of content in the refrigerant storage tank measured by the first scale is within a range between a first weight threshold and a second weight threshold, wherein the first weight threshold is less than zero; and in response to making the first pressure measurement and the first weight measurement, adjusting the first scale to read zero.

10. A non-transitory computer-readable memory having stored therein instructions executable by at least one processor to cause a processor to perform functions comprising:

determining a system, comprising a refrigerant storage tank and a first scale, transitioning to a first operating state;

in response to determining the system transitioning to the first operating state, determining, by the at least one processor, a first pressure measurement, wherein determining the first pressure measurement comprises determining a pressure within the refrigerant storage tank is less than a pressure threshold;

in response to determining the system transitioning to the first operating state, determining a first weight measurement, wherein determining the first weight measurement comprises determining a weight of content in the refrigerant storage tank measured by the first scale is within a range between a first weight threshold and a second weight threshold, wherein the first weight threshold is less than zero; and in response to making the first pressure measurement and the first weight measurement, adjusting the first scale to read zero.

11. The method of claim 1, wherein the first weight threshold is greater than a number equal to negative fifty percent of a capacity of the first scale.

12. The method of claim 3, further comprising:

determining, by the at least one processor, a new oil storage container is empty; and in response to determining the new oil storage container is empty, adjusting, by the at least one processor, a third scale to read zero.

13. The method of claim 12, further comprising:

receiving, by the at least one processor, an input indicative of the new oil storage container being empty, wherein receiving the input comprises receiving, by the at least one processor, an input entered via a user interface of the system.

14. The method of claim 4, further comprising:

determining, by the at least one processor, a new oil storage container is empty; and in response to determining the new oil storage container is empty, adjusting, by the at least one processor, a third scale to read zero.

15. The method of claim 6, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

16. The method of claim 1, wherein the first operating state comprises a power on operating state, a software reset operating state, a fill refrigerant storage tank operating state, a recover refrigerant operating state, a recycle refrigerant operating state, or a recharge refrigerant operating state.

17. The method of claim 1, wherein the pressure threshold is between 0.0 bar and 2.1 bar.

18. The method of claim 7, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

19. The method of claim 18, further comprising:

in response to making the second pressure measurement and the second weight measurement, outputting, by the at least one processor, a notification indicative of the system requiring service.

20. The method of claim 8, wherein the first operating state comprises a power on operating state, a software reset operating state, a fill refrigerant storage tank operating state, a recover refrigerant operating state, a recycle refrigerant operating state, or a recharge refrigerant operating state, and wherein the second operating state comprises the power on operating state, the software reset operating state, the fill refrigerant storage tank operating state, the recover refrigerant operating state, the recycle refrigerant operating state, or the recharge refrigerant operating state.

21. The method of claim 8, wherein the second operating state comprises a fill refrigerant storage tank operating state, and wherein the following step of the second operating state comprises opening at least one valve coupled to the refrigerant storage tank or within a supply line coupled to both the refrigerant storage tank and a supply refrigerant storage tank; the method further comprising: adding, during the fill refrigerant storage tank operating state, refrigerant into the refrigerant storage tank from the supply refrigerant storage tank.

22. The method of claim 1, wherein the first weight threshold is less than about −13.0 kilograms, and wherein the second weight threshold is greater than about 13.0 kilograms.

23. The method of claim 3, wherein the third weight threshold is less than 0.0 kilograms and greater than −0.5 kilograms, and wherein the fourth weight threshold is greater than 0.0 kilograms and less than 0.5 kilograms.

24. The method of claim 3, wherein the third weight threshold is less than zero and greater than a number equal to negative fifty percent of a capacity of the second scale, and wherein the fourth weight threshold is greater than zero and less than a number equal to positive fifty percent of the capacity of the second scale.

25. The method of claim 1, further comprising:

determining, by the at least one processor, a new oil storage container is not empty; and in response to determining the new oil storage container is not empty, performing, by the at least one processor, a following step of the first operating state.

26. The method of claim 25, wherein the first operating state comprises a fill refrigerant storage tank operating state, wherein the following step of the first operating state comprises opening at least one valve coupled to the refrigerant storage tank or within a supply line coupled to both the refrigerant storage tank and a supply refrigerant storage tank; and wherein the method further comprises:

adding, during the fill refrigerant storage tank operating state, refrigerant into the refrigerant storage tank from the supply refrigerant storage tank.

27. The method of claim 6, wherein the third weight threshold is less than 0.0 kilograms.

28. The method of claim 6, further comprising:

in response to making the second pressure measurement and the second weight measurement, outputting, by the at least one processor, a notification indicative of the system requiring service.

* * * * *